US011028627B2

(12) United States Patent
Øhlenschlæger et al.

(10) Patent No.: US 11,028,627 B2
(45) Date of Patent: Jun. 8, 2021

(54) HINGE FOR A WINDOW, A WINDOW INCLUDING A SET OF SUCH HINGES, AND A METHOD OF INSTALLING SUCH A WINDOW

(71) Applicant: VKR Holding A/S, Hørsholm (DK)

(72) Inventors: Terkel Øhlenschlæger, Vanløse (DK); Michael Galsgård Holm, Roskilde (DK); Esben Nordstrøm Tobias, Copenhagen (DK)

(73) Assignee: VKR Holding A/S, Hørsholm (DK)

( * ) Notice: Subject to any disclaimer, the term of this patent is extended or adjusted under 35 U.S.C. 154(b) by 26 days.

(21) Appl. No.: 16/610,886

(22) PCT Filed: May 7, 2018

(86) PCT No.: PCT/EP2018/061721
§ 371 (c)(1),
(2) Date: Nov. 4, 2019

(87) PCT Pub. No.: WO2018/202915
PCT Pub. Date: Nov. 8, 2018

(65) Prior Publication Data

US 2021/0079702 A1 Mar. 18, 2021

(30) Foreign Application Priority Data

May 5, 2017 (DK) ..... PA 2017 70314
May 30, 2017 (EP) ..... 17173577

(51) Int. Cl.
*E05D 7/12* (2006.01)
*E05D 11/00* (2006.01)
(Continued)

(52) U.S. Cl.
CPC ..... *E05D 11/0054* (2013.01); *E05D 7/085* (2013.01); *E05D 7/12* (2013.01);
(Continued)

(58) Field of Classification Search
CPC ..... Y10T 16/5357; Y10T 16/5358; Y10T 16/53607; E05D 2007/128; E05D 11/0054;
(Continued)

(56) References Cited

U.S. PATENT DOCUMENTS 2,808,611 A * 10/1957 Bauermeister ..... E05D 7/1044 16/258
4,069,548 A * 1/1978 Bierlich ..... E05D 7/086 16/341
(Continued)

FOREIGN PATENT DOCUMENTS

DE 9016313 4/1991
DE 102014007699 5/2015
(Continued)

OTHER PUBLICATIONS

PCT International Search Report dated Jul. 17, 2018.
(Continued)

*Primary Examiner* — Chuck Y Mah
(74) *Attorney, Agent, or Firm* — Merek Blackmon & Voorhees LLC

(57) ABSTRACT

In order to assist in mounting the hinge (210) on a window, the hinge comprises a mounting arrangement (250) including two mounting plates (251, 252) to be arranged on the frame of the window. The mounting arrangement includes at least one set of coupling means (253, 254) configured to engage with corresponding coupling means (263, 264) of the remaining components of the set of components of the hinge (210). The coupling means of the mounting arrangement (250) comprise at least one reception member (253, 254) provided on a respective mounting plate (251, 252) to engage with a respective engagement member (263, 264) of the coupling means of the remaining components by movement of the remaining components of the hinge substantially
(Continued)

in parallel with said hinge plane to provide a releasable connection between the remaining components of the hinge (210) and the mounting plates (251, 252).

19 Claims, 15 Drawing Sheets

(51) Int. Cl.
*E05D 7/085* (2006.01)
*E05F 1/12* (2006.01)

(52) U.S. Cl.
CPC ..... *E05F 1/12* (2013.01); *E05D 2011/0072* (2013.01); *E05Y 2600/528* (2013.01); *E05Y 2600/626* (2013.01); *E05Y 2900/152* (2013.01)

(58) Field of Classification Search
CPC ..... E05D 7/085; E05D 7/12; E05D 7/125; E05D 2011/0072; E05Y 2600/50; E05Y 2600/53; E05Y 2600/528; E05Y 2600/626; E05Y 2009/132; E05Y 2009/152; E05F 1/12; E05F 1/1261
See application file for complete search history.

(56) References Cited

U.S. PATENT DOCUMENTS 4,429,494 A * 2/1984 Kornerup ..... E05F 1/1075 49/346
4,446,597 A 5/1984 Dantzer-Sorensen
4,482,023 A * 11/1984 Dziedzic ..... E05C 1/04 16/262
4,802,307 A * 2/1989 Schmidt ..... E05D 15/1015 49/219
5,271,124 A * 12/1993 Sandell ..... E05D 7/085 16/370
5,568,702 A * 10/1996 Frank ..... E04D 13/0357 49/153
5,581,941 A * 12/1996 Sill ..... E04D 13/0357 49/246
6,061,872 A * 5/2000 Albrecht ..... E05D 7/0407 16/257
6,138,325 A 10/2000 Figliola
7,698,785 B2 * 4/2010 Bennett ..... E05D 3/16 16/369
8,011,064 B2 * 9/2011 Leimkuehler ..... E05D 11/0054 16/251
8,108,971 B2 * 2/2012 Florek ..... E05D 7/086 16/357
8,161,601 B2 * 4/2012 Alfredsson ..... E05D 7/1066 16/267
10,100,571 B2 * 10/2018 Deman ..... E05D 7/084
2001/0052705 A1 * 12/2001 Fisher ..... E05B 77/48 292/216
2004/0216274 A1 * 11/2004 Morgan ..... E05D 3/12 16/267
2007/0193572 A1 * 8/2007 Lee ..... E05D 7/12 126/194
2011/0049316 A1 * 3/2011 Vitoorapakorn ..... E05D 5/06 248/226.11

FOREIGN PATENT DOCUMENTS

| | | | | |
|---|---|---|---|---|
| DK | 114321 | | 6/1969 | |
| EP | 0022657 | | 2/1984 | |
| EP | 0089813 | | 8/1986 | |
| EP | 0456081 | B1 * | 6/1994 | ..... E05D 7/085 |
| EP | 1038083 | | 3/2002 | |
| EP | 1781883 | | 8/2010 | |
| EP | 2607588 | | 6/2013 | |
| EP | 2339103 | A3 * | 4/2014 | ..... E05D 7/084 |
| EP | 2770146 | | 8/2014 | |
| EP | 2770149 | | 8/2014 | |
| EP | 2921604 | | 9/2015 | |
| EP | 2947247 | | 11/2015 | |
| EP | 3034731 | | 6/2016 | |
| FR | 1241832 | | 8/1960 | |
| GB | 2557845 | A * | 6/2018 | ..... E05D 3/186 |
| WO | 0050718 | | 8/2000 | |
| WO | 2010/005331 | | 1/2010 | |
| WO | 2017/076416 | | 5/2017 | |

OTHER PUBLICATIONS

European Search Report for European Patent Application No. 17173577 dated Oct. 6, 2017.
PCT International Preliminary Report on Patentability dated Apr. 29, 2019.

* cited by examiner

HINGE FOR A WINDOW, A WINDOW INCLUDING A SET OF SUCH HINGES, AND A METHOD OF INSTALLING SUCH A WINDOW

TECHNICAL FIELD

The present invention relates to a hinge for a window having a frame and a sash, in which the hinge comprises a set of hinge components including a frame hinge part, a sash hinge part, a mounting arrangement and a plurality of movement supporting parts. The invention furthermore relates to a window including a set of hinges with a mounting arrangement, and to a method of installing such a window.

BACKGROUND ART

Basically, windows may be provided in a number of varieties and include more or less complicated structures in order to allow opening of the sash and to fulfil other functions, such as ventilation, while permitting cleaning of the outside of the pane from inside the building. The varieties include windows configured for installation in an inclined roof, of which one variety is roof windows of the pivoting type, the hinge axis being either located at the centre or displaced from the centre of the window, and top-hung roof windows that pivot for cleaning by means of an intermediate frame.

These requirements are made possible by the provision of a hinge with a particular pattern of movements, which in turn makes it possible to establish an overlap between the covering elements fastened to the frame and the counterpart covering elements fastened to the sash in the closed position of the roof window.

One very well-proven type of hinge is the pivot hinge including a guidance on the frame hinge part cooperating with a slide rail on the sash hinge part. Such pivot hinges are for instance disclosed in Applicant's EP 1 038 083 B1 and EP 1 781 883 B1, and are very versatile as regards operational areas and adaptation of components. Examples of roof windows incorporating such adapted hinges are shown in Applicant's published European patent applications EP 2 770 146 A1 and EP 2 770 149 A1.

However, as the traditional pivot hinges to some extent rely on frictional forces to operate correctly, it is desirable to utilize an alternative configuration of the hinge in certain fields of application, in which the desired pattern of movements is provided by a linkage mechanism. The use of such hinges, known as so-called pantograph hinges, including linkage mechanisms is traditionally most often known from the furniture field, but such hinges are also well-known to use for roof windows. Prior art examples include Danish patent No. 114 321, U.S. Pat. No. 4,446,597, and Applicant's European patents EP 22 657 B1 and EP 89 813 B1, and co-pending international application WO 2017/076416 A1.

Mounting a hinge comprising a linkage mechanism can be a challenge, since the frame hinge part and the sash hinge part are inherently connected to each other via the linkage mechanism itself. Subsequently, mounting the window sash to the frame may be heavy and tricky for one person to do, considering that during the step of installing the window sash, the installation person must hold the window sash in place and fasten the hinge at the same time. The installation process is complicated by the limited available space, as the set of hinges needs to be positioned between the sash and the frame, in a gap that for apparent reasons needs to be as small as possible, thus restraining the degree of freedom for transverse movements, i.e. in directions perpendicular to the hinge plane defined by the base plate of the frame hinge part. Further, once the window is installed it is difficult to have the window sash removed of the same reason as mentioned above without involving more than one person. Therefore, there is a need for an improved solution to install a window, in particular as regards connecting the hinge to the window frame.

SUMMARY OF INVENTION

With this background it is an object of the present invention to improve a hinge of the kind mentioned in the introduction with respect to the overall mounting conditions.

In a first aspect, this and further objects are met by the provision of a hinge for a window having a frame and a sash and adapted to define a hinge axis of the window, said hinge comprising a set of hinge components including: a frame hinge part having a base plate configured to be connected to a frame member of the frame; a sash hinge part having a base plate configured to be connected to a sash member of the sash; a mounting arrangement configured to assist in bringing the hinge from a supply condition to a mounted condition, in which the base plate of the frame hinge part is connected to the frame member and the base plate of the sash hinge part to the sash member; and a plurality of movement supporting parts, connected to a respective base plate of the frame hinge part and the sash hinge part, and configured to allow the sash hinge part to assume an angle relative to the frame hinge part, in which the base plate of the frame hinge part defines a hinge plane substantially perpendicular to the hinge axis of the window in the mounted condition of the hinge, the base plate of the sash hinge part being substantially parallel to the base plate of the frame hinge part, which is characterised by the features of the characterising portion of claim 1.

By providing the mounting arrangement with one or more mounting plates to be initially provided on the frame member, it is possible to achieve the facilitated installation of the window aimed at. A hinge including a mounting arrangement of this type thereby facilitates bringing the hinge from a supply condition to a mounted condition. The mutual engagement of the coupling means of the remaining components of the hinge with the coupling means of the mounting arrangement is easily carried out while at the same time taking place only in a plane parallel with the hinge plane. In this way, no transverse movements are required for attaining the releasable connection. Further, using a prefabricated mounting plate allows the installation to be accurate every time, taking positions and tolerances into account. Moreover, the provision of a mounting plate or mounting plates allows for connection and disconnection without the risk of destroying components of the hinge or any parts of the window when repeatedly being connected and disconnected. This is because the mounting plate may be configured to allow for repeatedly connecting and disconnecting of the window without the use of any penetrating or threaded fastening elements introduced into the material of the window itself and that may cause rupture. The coupling means may be configured without the use of loose fastening elements. By avoiding loose fastening elements, the installation of a window is facilitated even further since the complete installation may be done by one person, without the need for reaching out for fastening means such as screws etc. This type of installation using mounting plates is especially suitable when installing windows in challenging working positions, such as is often the case with roof windows. Since the window may be situated at an inclination and may involve working positions over the head, which are known to cause back and neck strain, it is a great advantage that the installation procedure is facilitated. It is noted that by the term "installation of a window" it is understood that this encompasses assembly of various components constituting or forming a window. During installation of the window, the coupling preferably takes place by first sliding the bolt into the slot and subsequently rotating the base plate of the frame hinge part and the other remaining components of the hinge about the bolt. Initial engagement of these coupling means is logical, and during installation of the window, the installer is supported in that once the coupling has been obtained, the weight of the sash is sustained by the mounting plate connected to the frame. The weight of the sash is often substantial, since the sash is carrying not only the remaining components of the hinge but also the pane. By forming the second engagement member of the coupling means of the remaining components as comprising a shoulder portion, and the second reception member of the coupling means of the mounting arrangement as comprising a spring-biased latch element provided with an abutment portion to engage with said shoulder portion in the mounted condition, it is ensured in this manner that secure engagement of the respective coupling means is obtained as a logical step during installation. It is noted that with the provision of the spring-biased latch element to engage with the shoulder portion, a "semi-automatic" connection may be obtained by simply rotating the sash relative to the frame in the closing direction, thus without the need for additional steps or tools.

The definitions of "frame" and "sash" should be interpreted as encompassing any structure fulfilling the requirements of acting as parts in an openable window. Although the mounting plate of the mounting arrangement is described as being configured for arrangement on the stationary frame, it is also conceivable to mount the hinge inversely, i.e. connecting the mounting plate or plates on the movable sash, or other movable frame, and arranging the remaining components of the set of hinge components on the frame. The coupling procedure is then carried out in a manner corresponding to the one described.

The terms "remaining components of the set of hinge components" and "remaining components of the hinge" are used interchangeably. In the present context, the term "remaining components of the hinge" encompasses any component forming part of the hinge excluding the mounting plate or plates and parts associated thereto.

In a presently preferred embodiment, the spring-biased latch element is connected to said at least one mounting plate in a pivotal connection. This provides for an advantageous and simple way of allowing the second engagement member to be coupled to the second reception member during installation while at the same time being able to provide the required releasability of the coupling.

The spring-bias of the latch element may in principle be carried out in any suitable manner; however, a mechanically reliable and simple solution is found by providing the spring-bias by a leaf spring and the latch element with a spring engagement portion. To this end, the mounting plate may include a spring pocket for receiving an end of the leaf spring. In a preferred development of this embodiment, the base late of the frame hinge part is provided with a protruding bottom portion to interact with the leaf spring.

In a further presently preferred embodiment, the spring-biased latch element includes a tongue portion acting as a handle for release of the releasable connection.

Further ease of installation is obtained by providing the spring-biased latch element with a guide portion.

In a still further presently preferred embodiment, the mounting arrangement comprises a first mounting plate and a second mounting plate. This opens up to a more flexible configuration of the mounting arrangement and associated details.

As a further development of the still further presently preferred embodiment, the second mounting plate comprises a cover portion. In this way, a safe and aesthetically pleasant protection of the parts behind the cover portion is obtained.

The principles underlying the present invention are generally applicable to all kinds of hinges; however, it is particularly advantageous in case the movement supporting parts of the hinge comprises a linkage mechanism including links, springs and at least one pick-up element to provide the hinge as a pantograph hinge.

In a second aspect, a window including a set of hinges is provided, and in a third aspect, a method of installing such a window is provided.

Other presently preferred embodiments and further advantages will be apparent from the following detailed description and the dependent claims.

BRIEF DESCRIPTION OF DRAWINGS

The invention will be described in more detail below by means of non-limiting examples of embodiments and with reference to the schematic drawing, in which.

DESCRIPTION OF EMBODIMENTS

Figure 1:
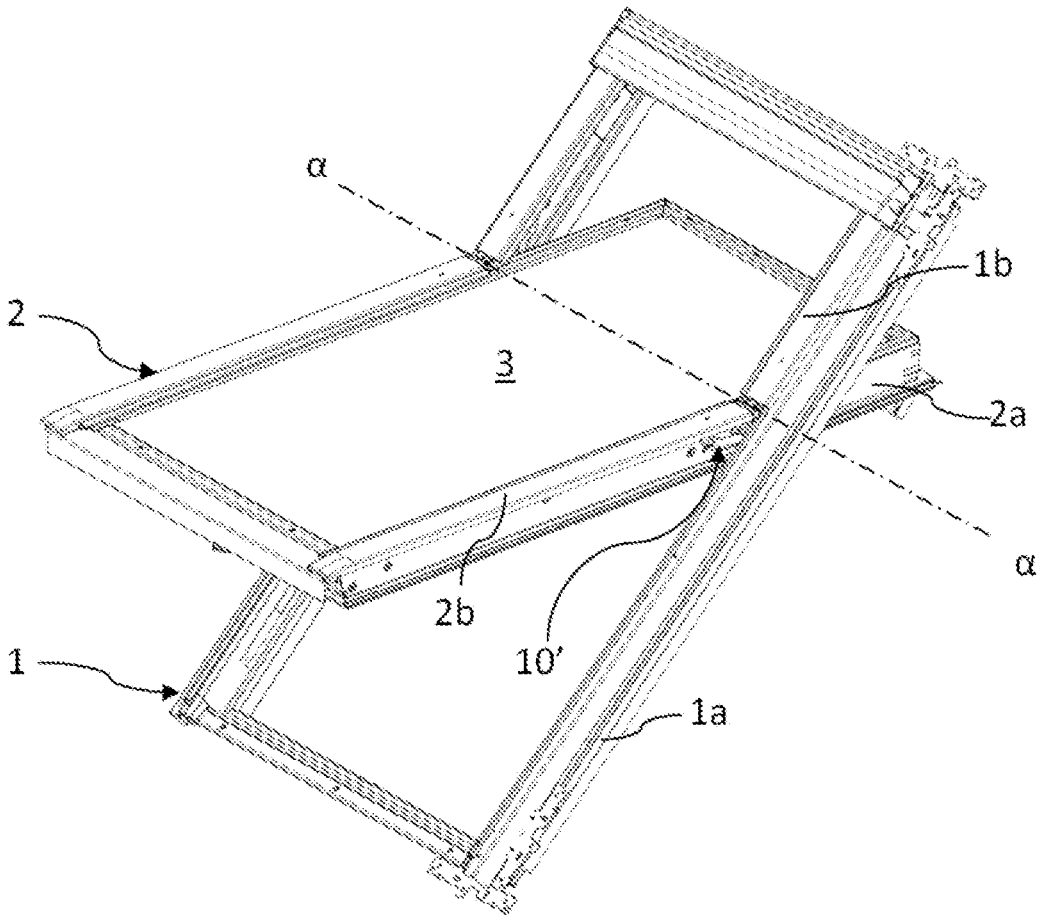
Fig. 1 (Prior art)
FIG. 1 is a perspective view of a prior art window.

In the following, embodiments of the inventive hinge and window will be described in further detail, with reference to a window with a prior art hinge 10' is shown in FIG. 1. Such a hinge 10' and other parts of the window which are applicable also to a window according to the invention are described in Applicant's published European patent applications EP 2 770 146 A1 and EP 2 770 149 A1 to which reference is hereby explicitly made. It is hence to be understood that the hinge and mounting arrangement according to the invention replaces the prior art hinge 10' at one or both sides of the window.

In a manner known per se, the window comprises a sash 2 carrying a glazing in the form of a pane 3 and a frame 1. The window is intended to be built into a surface, which is inclined with respect to the horizontal, typically a roof, and the window will in the following be referred to as roof window. At a position between the top and centre of the window, there is a hinge connection between the frame 1 and the sash 2. The hinge connection in FIG. 1 comprises a set of two prior art hinges, of which one hinge 10' is visible. The frame 1 and sash 2 is each formed by four members of which one frame side member la and one sash side member 2*a* are indicated. The sash 2 is openable with respect to the frame 1, as the sash 2 may be moved from a closed position, in which e.g. the sash side member 2*a* is substantially parallel with the frame side member 1*a,* to an open position, in which the sash side member 2*a* forms an angle with the frame side member 1*a.* During this movement the sash 2 rotates about a hinge axis α situated at the hinge connection. As indicated in FIG. 1, the hinge axis α is located between a centre axis and the top of the roof window, preferably in the interval ⅓ to ⅔ of the distance between the centre axis and the top, most preferred substantially at ½ of the distance between the centre axis and the top. Other positions of the hinge axis are of course conceivable, for instance at the centre of the roof window. A corresponding operation of the window as described above and from here on is also true for the type of hinge described in the Applicant's co-pending international application published under WO 2017/076416 A1. Common to the hinge types applicable in such windows is that a number of movement supporting parts are provided in the hinge, as will be described further below.

To protect the interior and the components of the window itself and to ascertain weather-proof transition to the surrounding roofing, the roof window comprises a covering, including flashing members (not shown), cladding and covering elements of which a frame side covering element 1*b* and sash side covering element 2*b* are shown.

From a closed position, the user operates the operating device of the window. The operating device typically comprises a handle (not shown) connected with the sash bottom member and/or an operating and locking assembly including a ventilation flap at the sash top member with a lock mechanism to interact with a striking plate on the frame top member. The hinge 10 exerts a moment on the sash 2, and in combination with the force, and hence moment, exerted by the user operating the operating device, the moment resulting from the weight of the sash 2 and pane 3 is overcome, along with any frictional forces present. All in all, the opening operation entails that the sash 2 is moved from a closed position to an open position as represented by FIG. 1, in which the sash plane forms an opening angle with the frame plane. Closing the window from the open position entails the opposite movement of the sash 2. It is possible to position the sash 2 in a number of arbitrary opening positions, in which the sash 2 is held stable relative to the frame 1. The sash 2 is also able to be rotated substantially through 180° to allow cleaning of the outside of the pane 3 from the inside of the building in which the roof window is installed.

Referring now to FIGS. 2 to 6, a first embodiment of a hinge 110 according to the invention will be described in detail.

When referring to the Figures, the terms up, down, upwards, downwards, top and bottom are taken relative to how the figures are displayed, that is having the frame arranged in a lying position with the covering elements facing upwards. A front view is taken from the hinge and viewing towards the frame. A view from behind is therefore taken as viewed from the frame towards the hinge. A longitudinal direction is, if nothing else is mentioned, longitudinal along the length of the frame member. It is to be understood that the arrangement shown in a horizontal orientation is not the normal orientation as the window is installed in an inclined roof.

Figure 2:
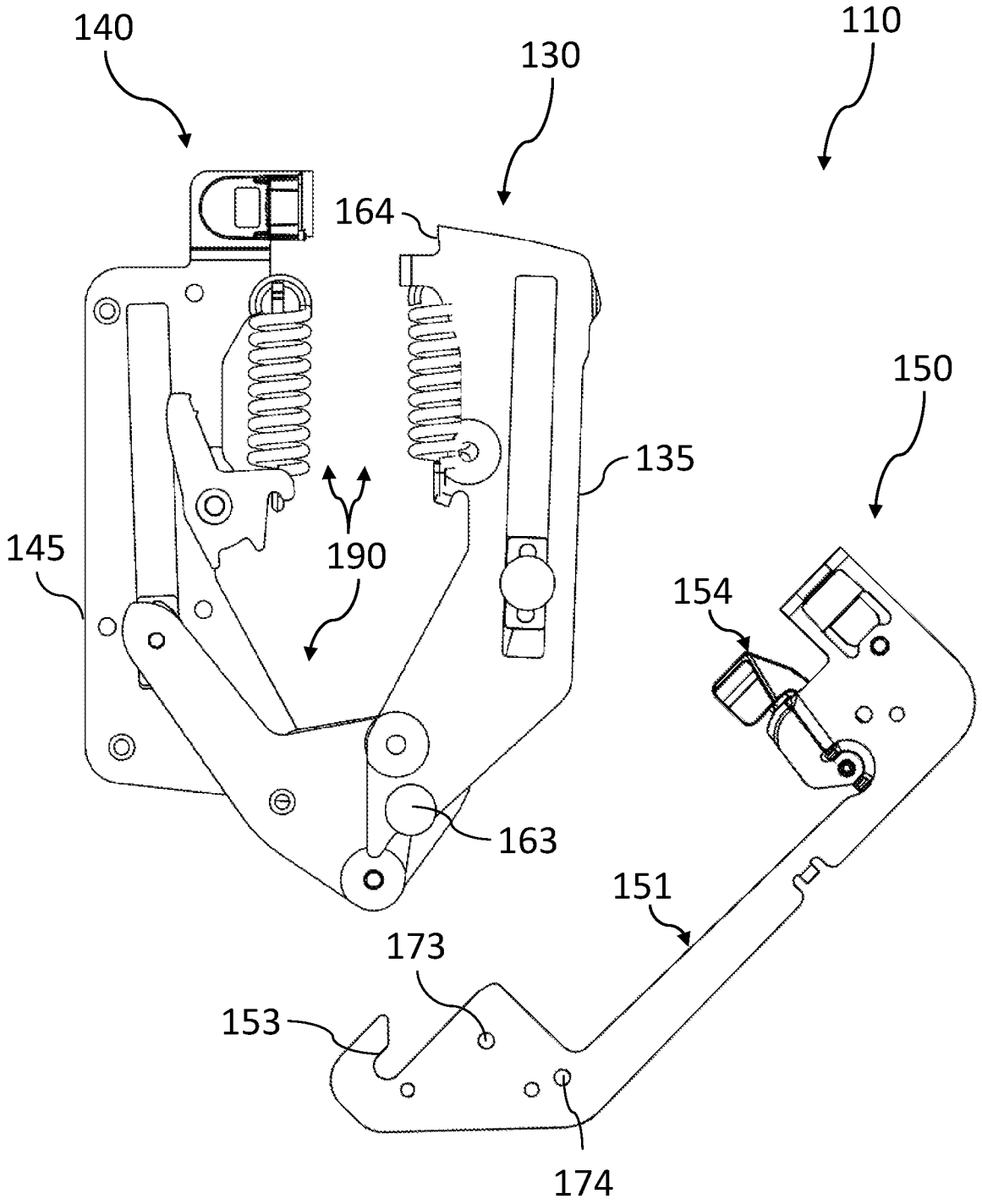
FIG. 2 is an exploded front view of a hinge in a first embodiment of the invention, shown in a position corresponding to an initial step of an installation process.
Figure 3:
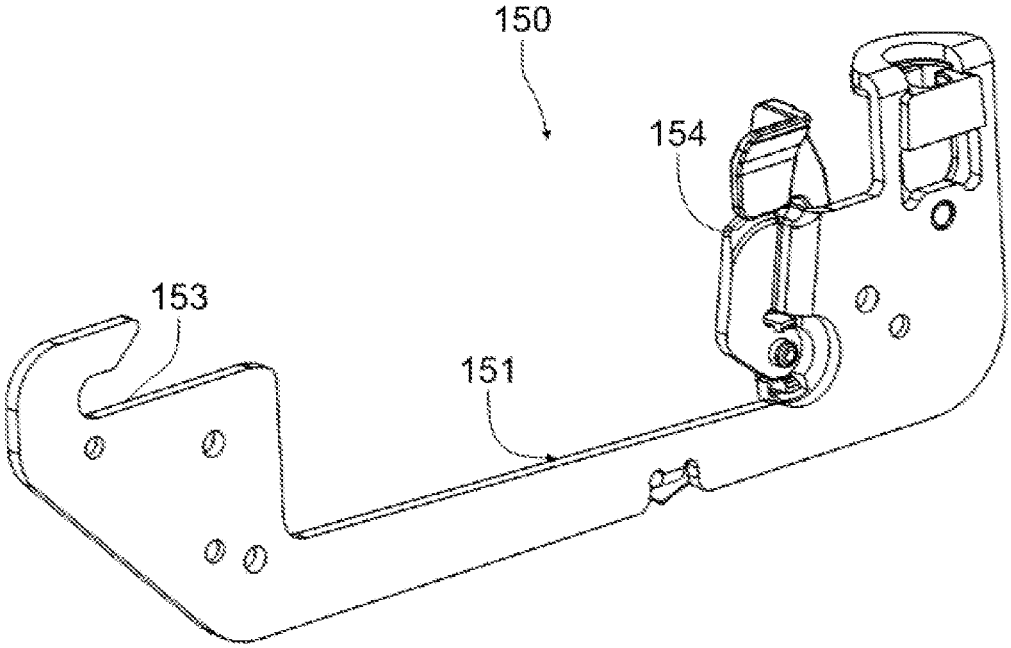
FIGS. 3 to 6 are perspective views of details a hinge in the first embodiment of the invention, from different angles.

In FIG. 2, the hinge 110 is shown in a position corresponding to an initial step of an installation process. This position also corresponds to a supply condition of the hinge according to the invention. The hinge 110 comprises a frame hinge part 130 and a sash hinge part 140 configured to assume an angle relative to the frame hinge part 130. The hinge 110 forms part of a set of hinges, of which the frame hinge part 130 of each hinge 110 is configured to be connected to the frame side member 1*a* of the frame 1 of the roof window in a mounted condition by a mounting arrangement to be described in further detail, at a location chosen to provide the desired position of the hinge axis α, and the sash hinge part 140 is correspondingly configured to be connected to the sash side member 2*a*.

As in the prior art hinge 10', the base plate 135 of the frame hinge part 130 defines a hinge plane substantially perpendicular to the hinge axis α of the window in the mounted condition of the hinge, the base plate 145 of the sash hinge part 140 being substantially parallel to the base plate 135 of the frame hinge part 130. The hinge 110 moreover comprises a plurality of movement supporting parts 190, connected to a respective base plate 135, 145 of the frame hinge part 130 and the sash hinge part 140, and configured to allow the sash hinge part 140 to assume an angle relative to the frame hinge part 130. In the specific embodiments shown and described, the movement supporting parts 190 comprises a linkage mechanism including links, springs and at least one pick-up element to provide the hinge as a pantograph hinge. For a description of the parts and operation of such a pantograph hinge, explicit reference is hereby made to the embodiment shown in and described in relation to FIGS. 2 to 5 of the above-mentioned WO 2017/076416 A1. In principle, however, the fundamental principles of the invention are also applicable to traditional pivot hinges including an arc-shaped guidance on the frame hinge part to receive an arc-shaped slide on the sash hinge part.

A mounting arrangement generally designated 150 comprises a mounting plate 151 which is shown in the position it will take in the mounted condition of the hinge on the frame side member 1*a* with fastening means which can be for example pins or spigots (not shown in this embodiment, cf. second embodiment), or any type of threaded fastening means. The spigots are configured to be arranged in corresponding holes 173, 174 on the mounting plate 151. Preferably, the spigots are arranged such that they end in flush with an outer surface 151*a* of the mounting plate 151 in order to avoid collision with the components of the frame hinge part 130. The outer surface 151*a* is the surface of the mounting plate 151 that faces the frame side member 1*a,* an inner surface 151*b* facing away from the frame side member 1*a* in the mounted condition. The base plate 145 of the sash hinge part 140 is provided with corresponding spigots (not described in detail).

The remaining components of the hinge 110 shown in FIG. 2, i.e. the base plate 135 of the frame hinge part 130, the movement supporting parts 190 and the sash hinge part 140 with its base plate 145, are in a position corresponding to that the sash (not shown) would have in this initial step of installation, namely substantially vertical. This position also corresponds to the supply condition of the hinge on the window, in which these remaining components are all connected to the sash. Hence, in the supply condition, only the mounting plate (or mounting plates, if more than one) of the hinge is fastened to the frame.

Figure 7:
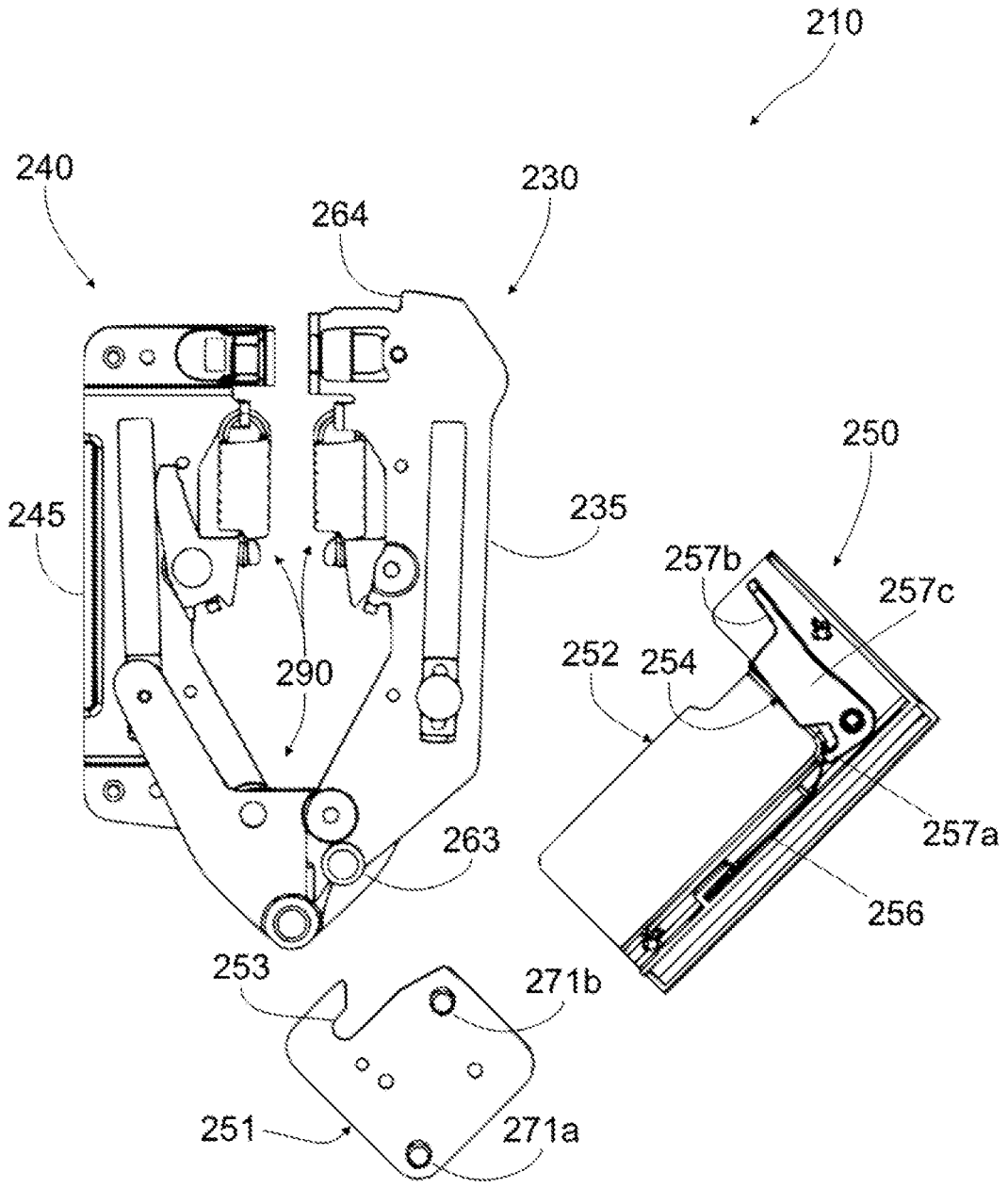
FIG. 7 is a view corresponding to FIG. 2, of a hinge in a second embodiment of the invention.

This initial step is common to the first embodiment, the second embodiment (cf. FIG. 7) and further embodiments. Elements having the same or analogous function as in the first embodiment are provided with the same reference numerals to which 100, 200, 300 and 400, respectively, have been added. The operational principles underlying the invention are thus based on the following fundamental features, referring now jointly to FIGS. 2 and 7, and described referring only to the first and second embodiments:

The mounting arrangement 150; 250 has one or more mounting plates 151; 251, 252 arranged on the frame member 1*a* substantially in parallel to the base plate 135; 235 of the frame hinge part 130; 230 in the mounted condition. At least one set of coupling means 153, 154: 253, 254 is configured to engage with corresponding coupling means 163, 164; 263, 264 of the remaining components of the set of components of the hinge 110; 210. The coupling means of the mounting arrangement 150; 250 comprise at least one reception member 153, 154; 253, 254 provided on the at least one mounting plate 151; 251, 252 to engage with a respective engagement member 163, 164; 263, 264 of the coupling means of the remaining components by movement of the remaining components of the hinge substantially in parallel with said hinge plane to provide a releasable connection between the remaining components of the hinge 110; 210 and the at least one mounting plate 151; 251, 252.

In all shown embodiments, a first engagement member of the coupling means of the remaining components of the hinge is a bolt 163; 263 provided on the base plate 135; 235 of the frame hinge part 130; 230, and a first reception member is a slot 153; 253 in one of the mounting plates 151; 251 adapted to receive the bolt 163; 263. It is preferred that from the position shown in FIGS. 2 and 7, the remaining components of the hinge are moved downwards and the bolt 163; 263 is first slid into the slot 153; 253. Subsequently the base plate 135; 235 of the frame hinge part 130; 230 and the other remaining components of the hinge 110; 210 are rotated about the bolt 163; 263 to provide an at least temporary retention of the remaining components of the hinge relative to the at least one mounting plate 151; 251.

It is noted that during the entire movement, the respective planes of the mounting plate and the base plates of the frame hinge part and the sash hinge part are at all times kept substantially parallel, thus avoiding transverse movements perpendicular to the hinge plane as defined by the base plate 135; 235 of the frame hinge part 130; 230.

Following the engagement of the coupling means of remaining hinge components with the coupling means of the mounting arrangement as described in the above, the window sash is in "safe position", as the weight of the sash is transferred to the frame via the mounting arrangement. The installer is thus in principle free to leave the window at least temporarily.

An increased security against unintentional release is however increased if also a secondary coupling is present.

According to the invention, and as shown in connection with the first and second embodiments, a second engagement member of the coupling means of the remaining components comprises a shoulder portion 164; 264, and the second reception member of the coupling means of the mounting arrangement 150; 250 comprises a spring-biased latch element 154; 254 provided with an abutment portion 155; 255 to engage with said shoulder portion 164; 264 in the mounted condition.

As shown, the spring-biased latch element 154; 254 is here connected to the mounting plate in question, the mounting plate 151 in the first embodiment, and a second mounting plate 252 in the second embodiment, in a pivotal connection 159; 259.

The spring-bias of the latch element 154; 254 is specifically provided by a leaf spring 156; 256 and the latch element 154; 254 includes a spring engagement portion 157*a;* 257*a.* As shown in detail only in connection with the second embodiment, the leaf spring 256 is received in a spring pocket 256*a* of the second mounting plate 252. Other means of accommodating the leaf spring are conceivable.

The provision of the spring-biased latch element 154; 254 ensures a simple, precise and reliable secondary coupling between the remaining hinge components and the mounting arrangement such that the releasable connection is achieved in a "semi-automatic" step when rotating the sash relative to the frame during installation.

In order to be able to release the engagement in an easy manner, the spring-biased latch element 154; 254 in the specific first, second and third embodiments includes a tongue portion 157*b;* 257*b* acting as a handle for release of the releasable connection.

A further detail of the latch element 154; 254 is the presence of a guide portion 157*c;* 257*c.* The guide portion 157*c;* 257*c* is particularly useful during installation, i.e. activation of the releasable connection, and when releasing the connection.

Although the releasable connection is thus achieved without the need for carrying out additional steps to secure the sash to the frame, an additional locking device may be incorporated in the hinge or mounting arrangement. It is conceivable to utilise parts of the window covering for locking the set of hinge components relative to each other in the mounted condition of the hinge. Examples of locking devices are conceivable to the person skilled in the art.

One difference between the first and second embodiments is that in the second embodiment, the mounting arrangement 250 comprises a first mounting plate 251 and the second mounting plate 252 mentioned above. Referring also to the above description, it is apparent that the first reception member 253 is positioned in the first mounting plate 251 and the second reception member in the form of spring-biased latch element 254 is associated to the second mounting plate 252.

Another difference is that the second mounting plate 252 comprises a cover portion 258 ensuring that the operational parts of the mounting arrangement are hidden to the user. In principle, the only exception is the tongue portion 257*b* acting as a handle for release of the connection which is accessible to the user. It is noted that the provision of a cover portion is also conceivable in connection with the first embodiment.

The fastening of the respective mounting plates 251, 252 to the frame side member is ensured in substantially the same way as with the one-piece mounting plates of the first embodiment, namely via spigots 271*a,* 271*b* on the first mounting plate 251, and spigots 272*a,* 272*b* on the second mounting plate 252. Only holes 273, 274 in the first mounting plate 251 for spigots 271*a,* 271*b* are shown. It is for instance conceivable to form the second mounting plate 252 in one-piece as a moulded part of a suitable plastic material, including the cover portion 258 and the spigots 272*a,* 272*b.*

Figure 15:
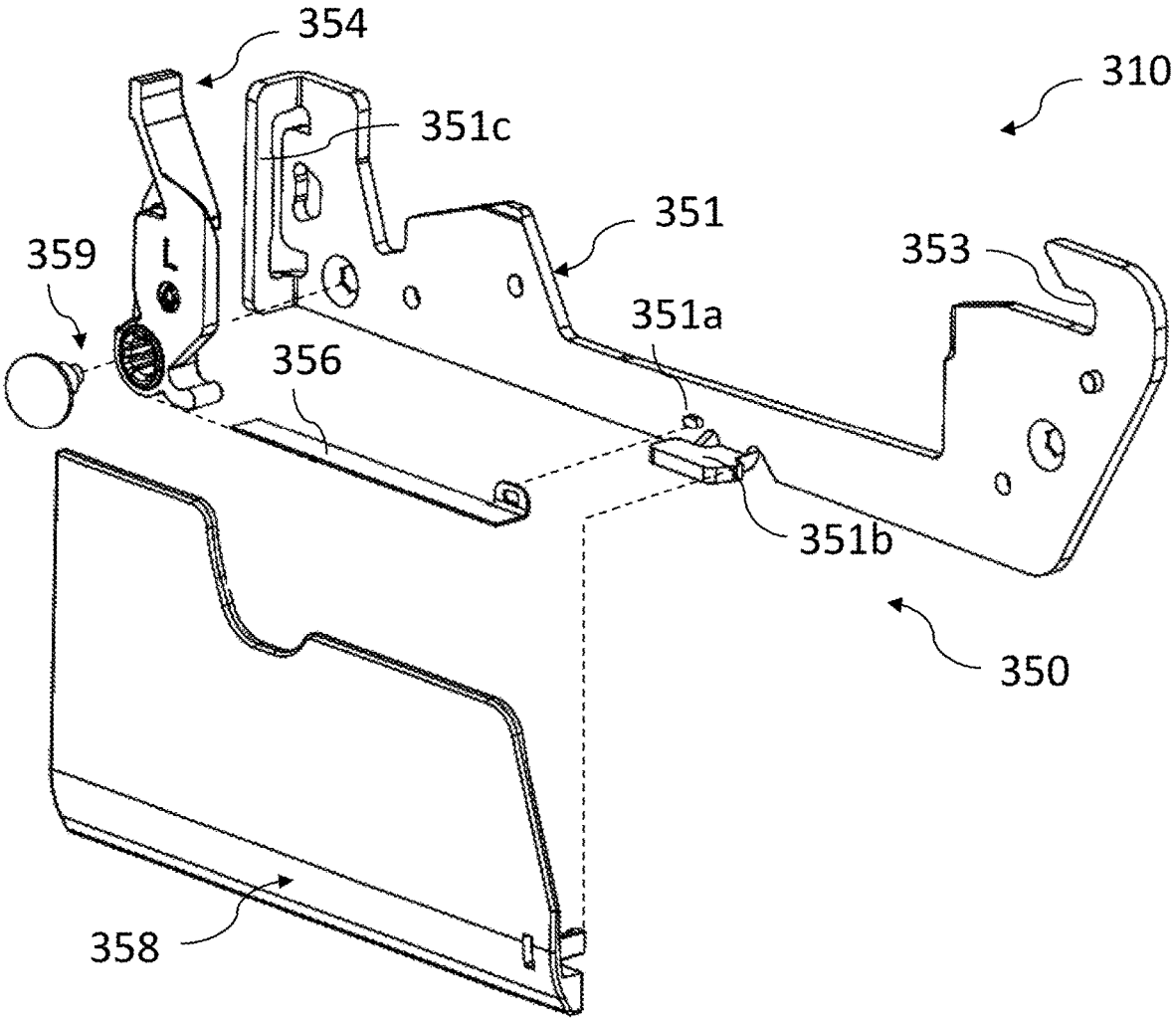
FIGS. 15 and 16 show details of a hinge in a third embodiment of the invention.
Figure 16:
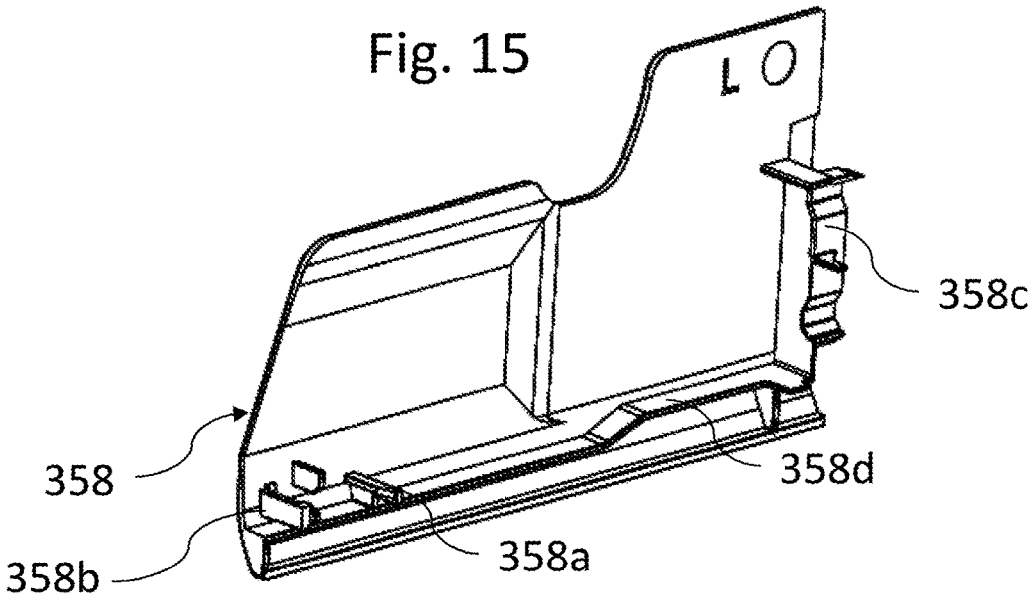
Figure 17:
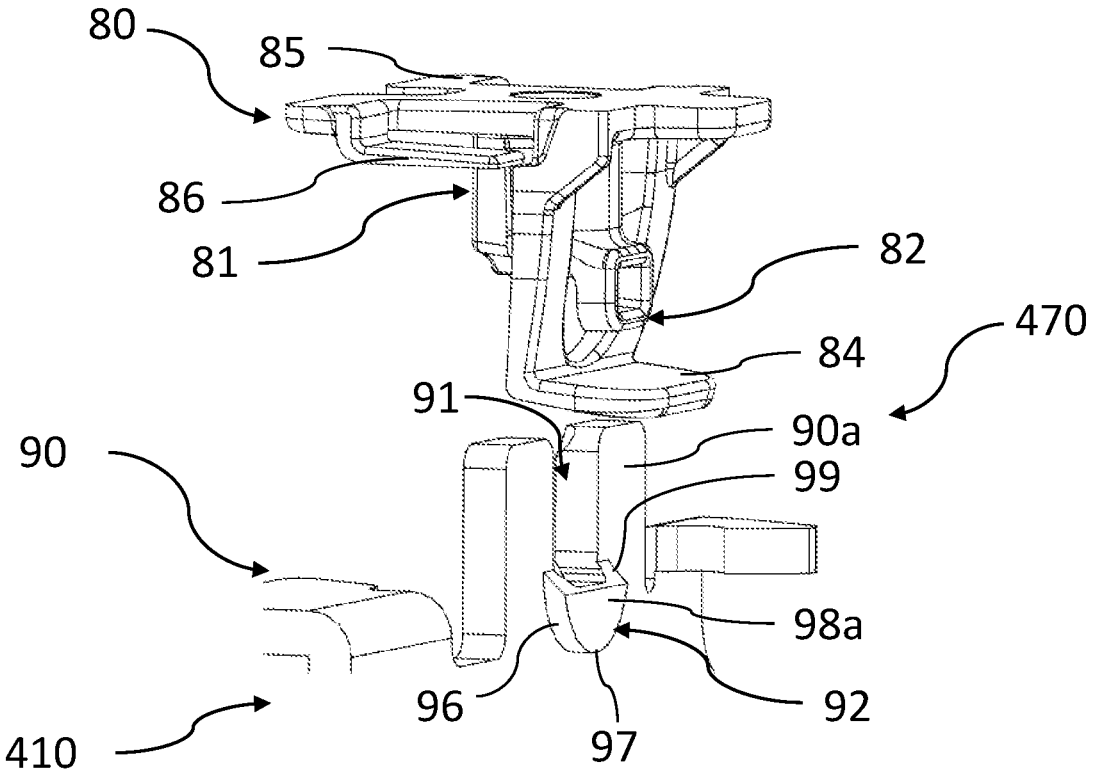
FIGS. 17 to 22 show perspective views from different angles of details of a hinge in a fourth embodiment of the invention.
Figure 18:
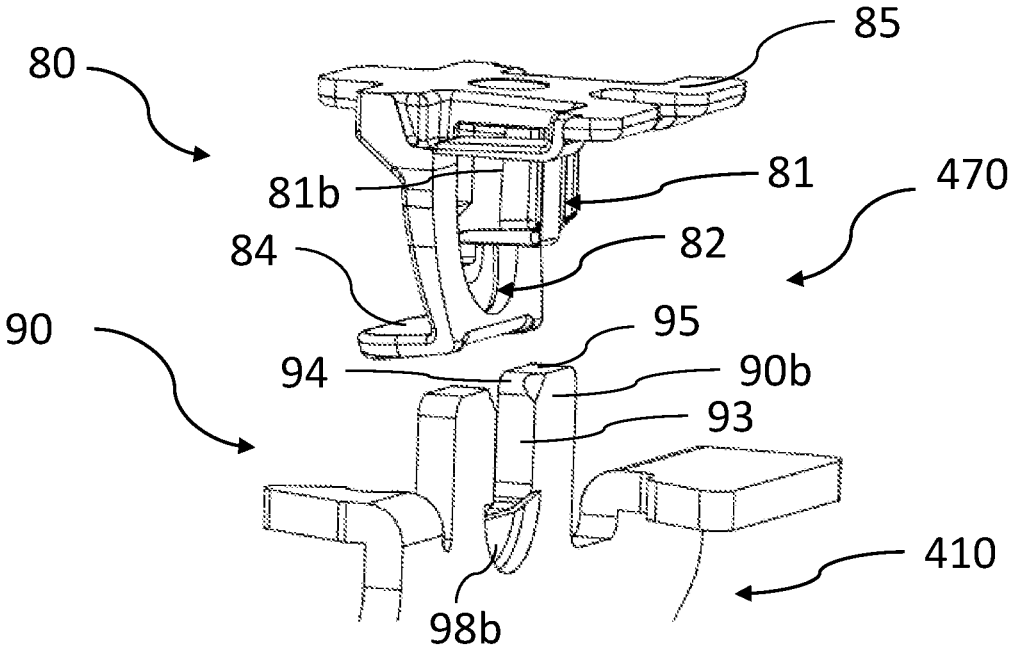
Figure 19:
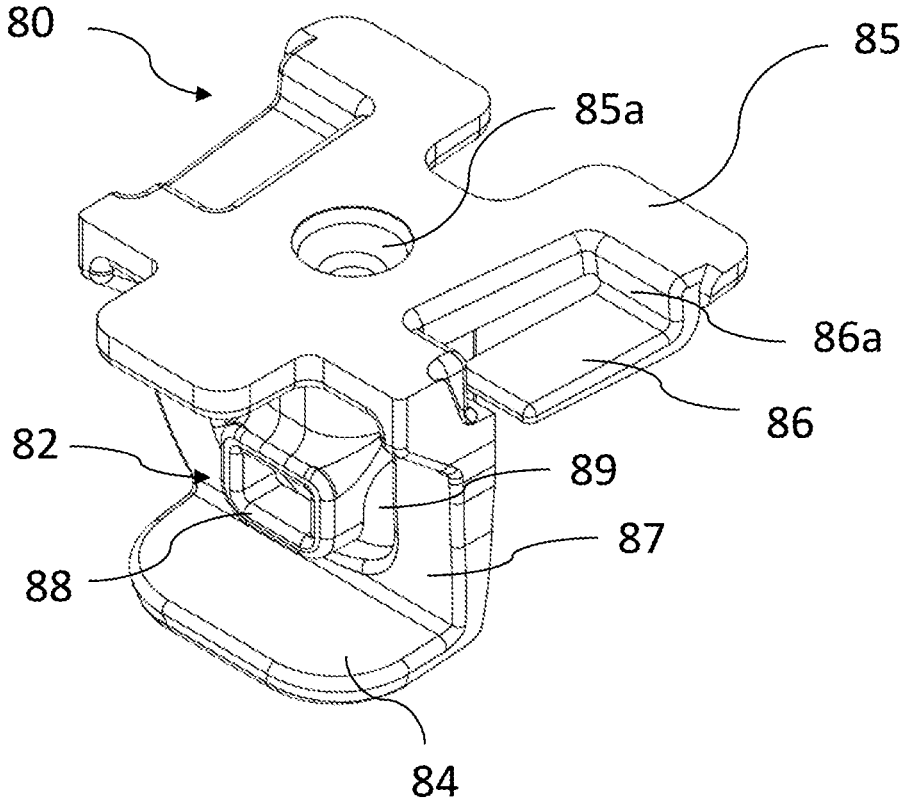
Figure 20:
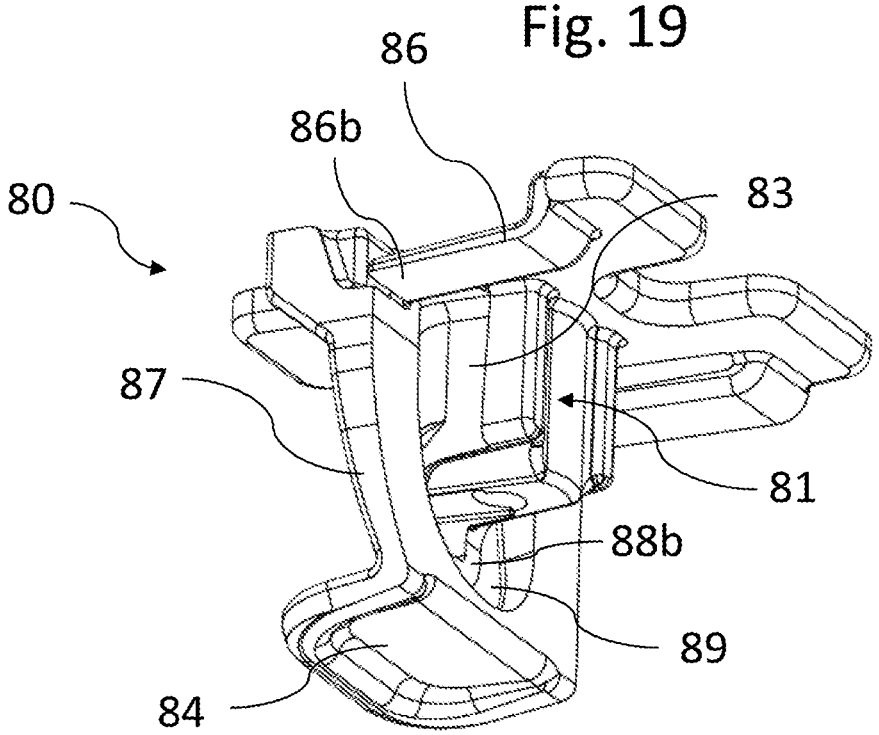
Figure 21:
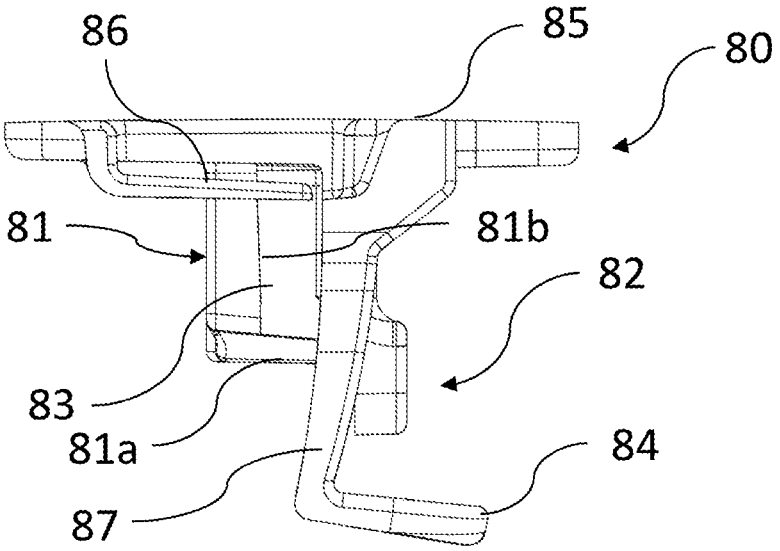
Figure 22:
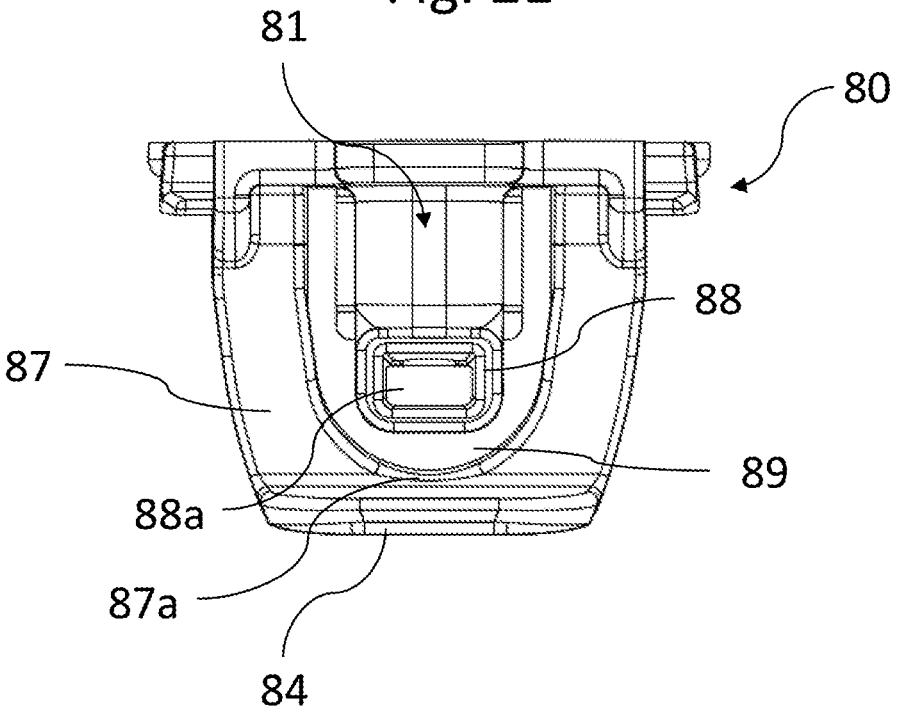

Referring now to FIGS. 15 and 16, details of a third embodiment of a hinge generally designated 310 are shown. Only differences relative to the first and second embodiments will be described in detail.

As in previously described embodiments, the hinge 310 comprises a mounting arrangement 350 comprising a mounting plate 350 in which a first reception member in the form of slot 353 is provided. A second reception member in the form of latch element 354 is provided as well.

Spring 356 for biasing the latch element 354 extends from under the latch element 354 to a hook-up section at a spring engagement protrusion 351*a* on the mounting plate 350.

A cover 358 is provided as well, configured to be connected to the mounting plate 351 by means of first and second engagement means 358*b*, 358*c* to engage with first and second cover engagement protrusions 351*b*, 351*c* on the mounting plate 351. As is furthermore apparent, the cover 358 has a first spring abutment portion 358*a* and a second spring abutment portion 358*d*.

Figure 4:
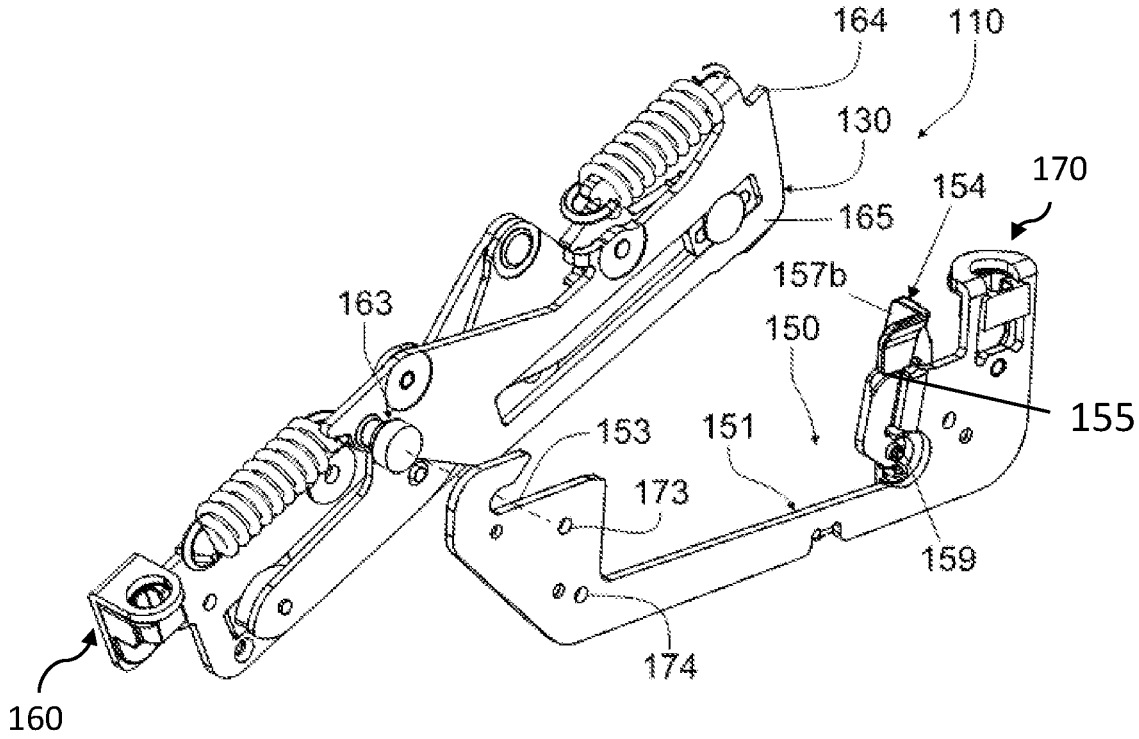
Figure 5:
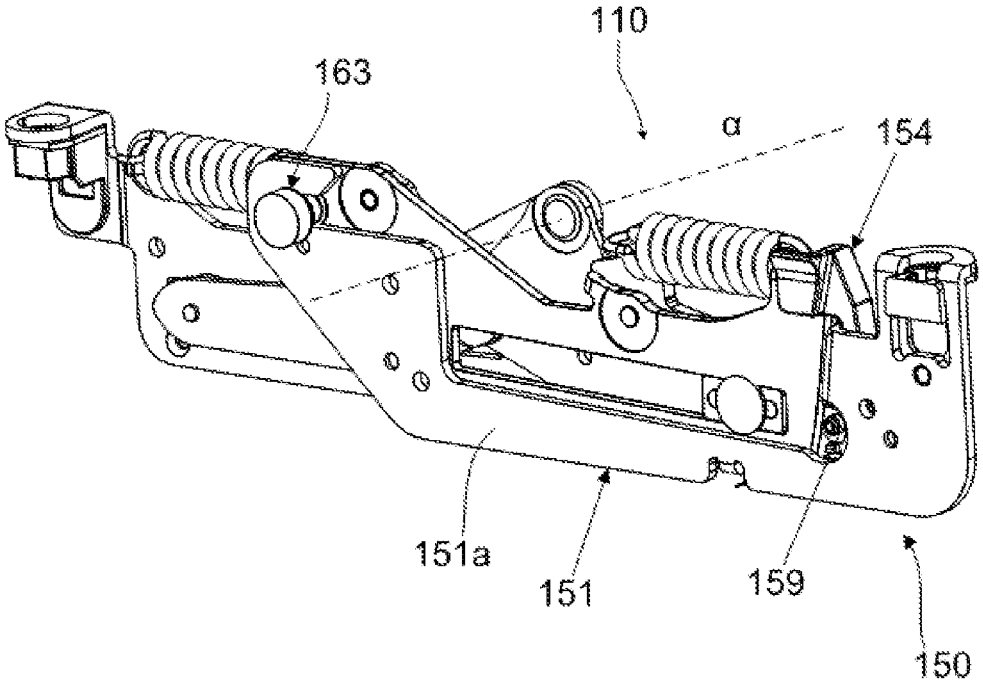
Figure 6:
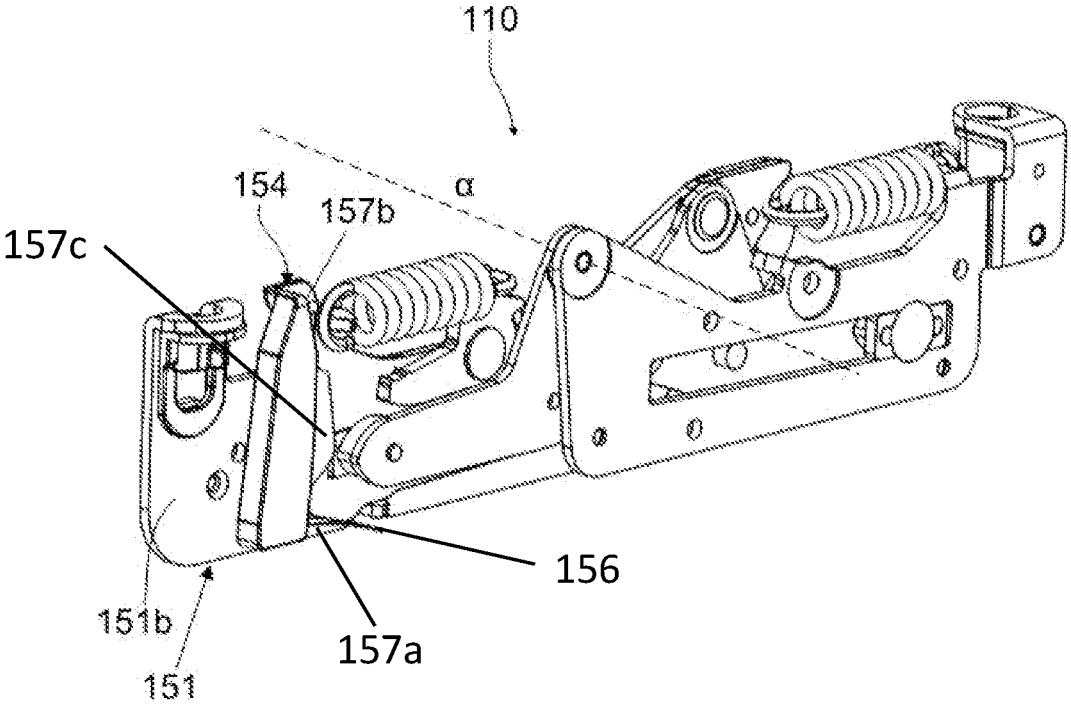
Figure 8:
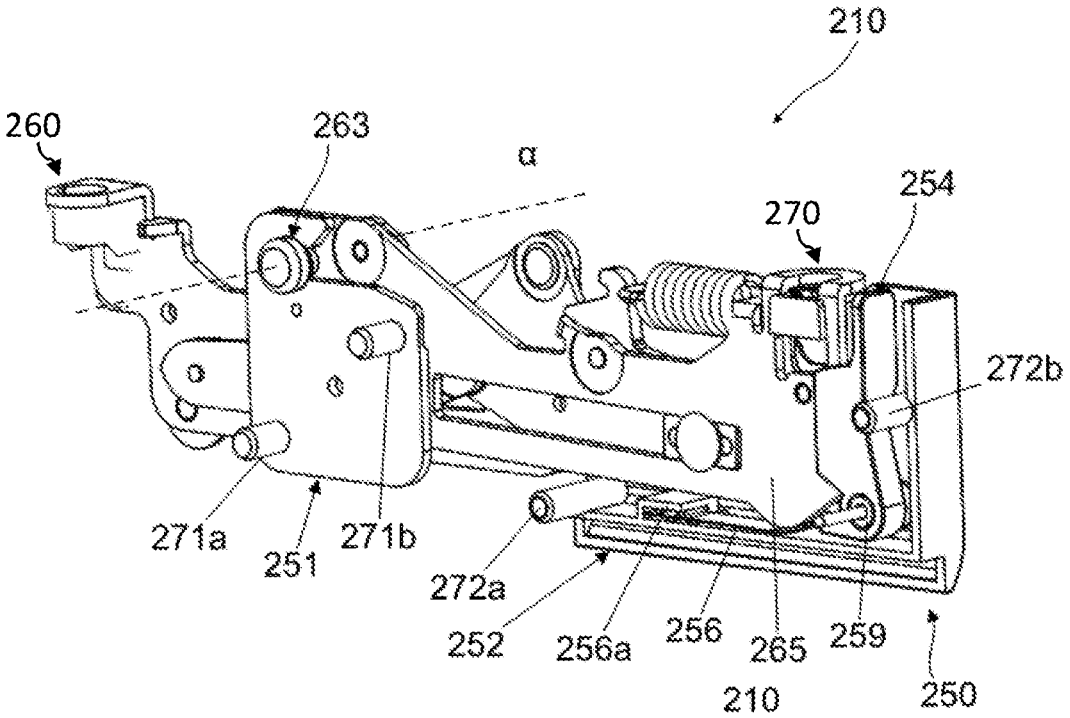
FIGS. 8, 9, 10*a*, 10*b*, 11*a*, 11*b*, 12*a*, 12*b*, 13*a*, 13*b*, 14*a* and 14*b* are all views showing details of the hinge in the second embodiment of the invention.
Figure 9:
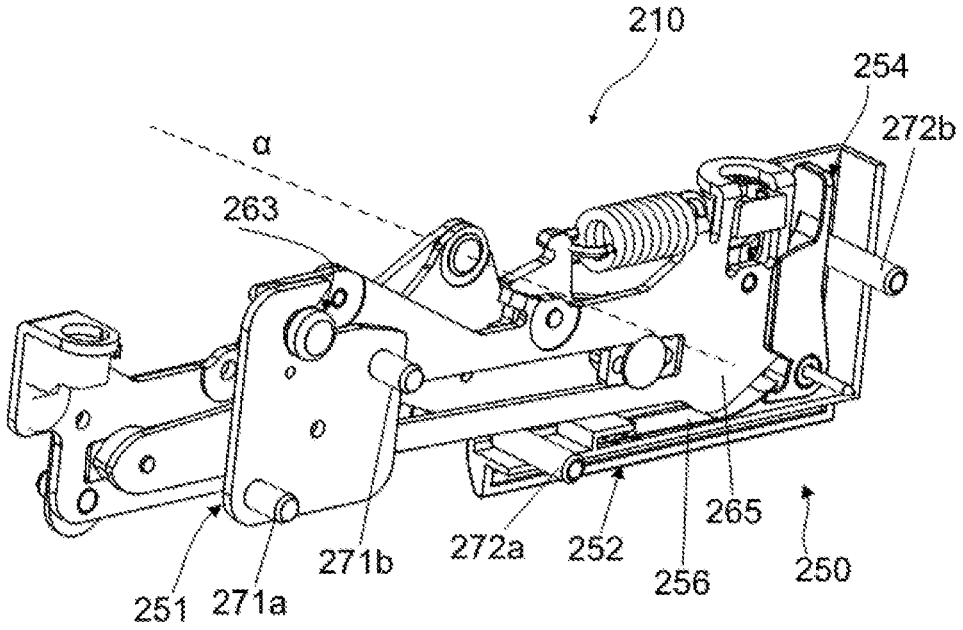
Figure 10A:
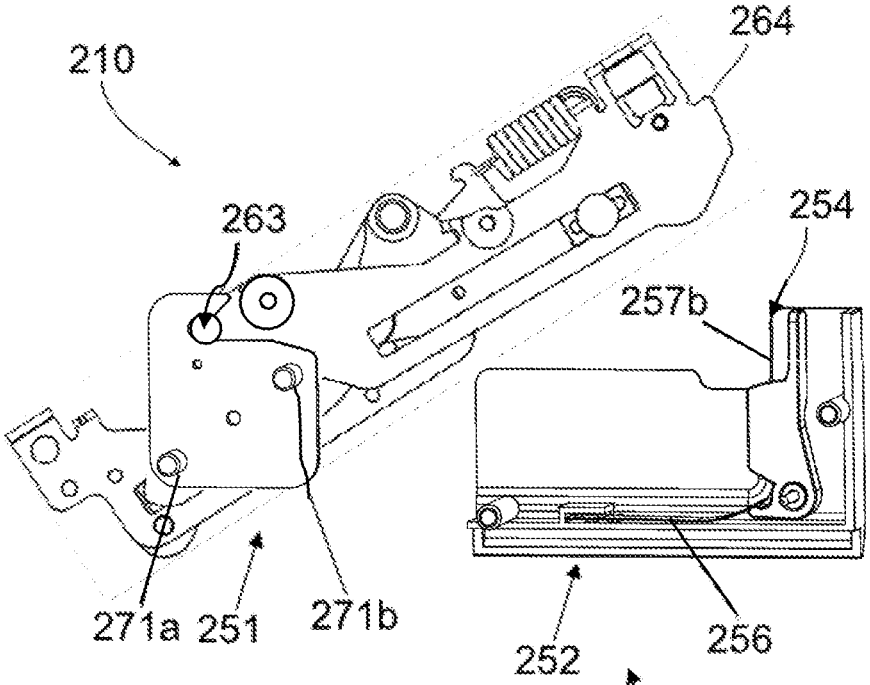
Figure 10B:
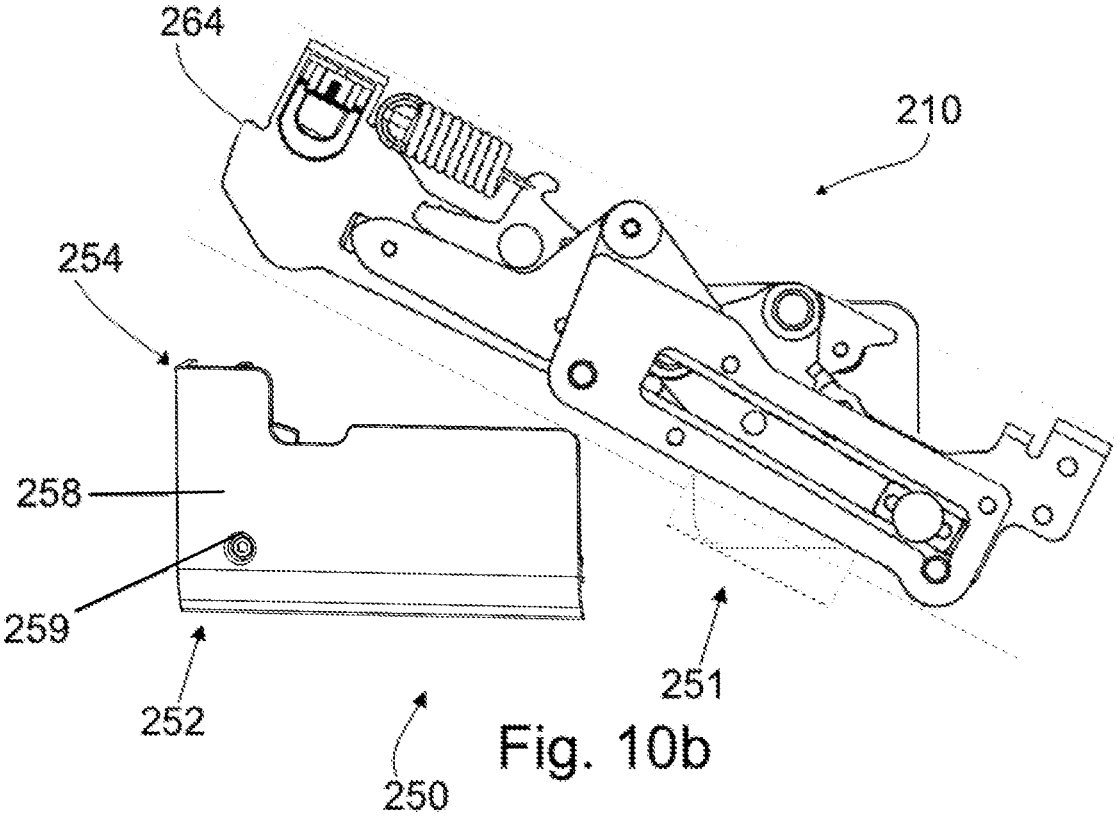
Figure 11A:
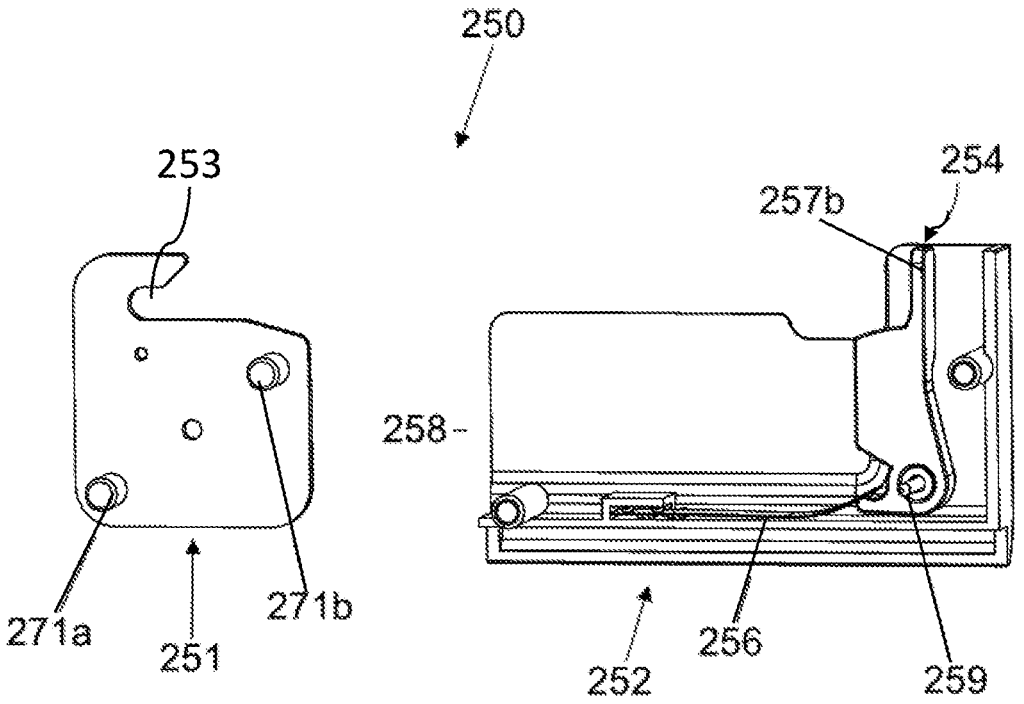
Figure 11B:
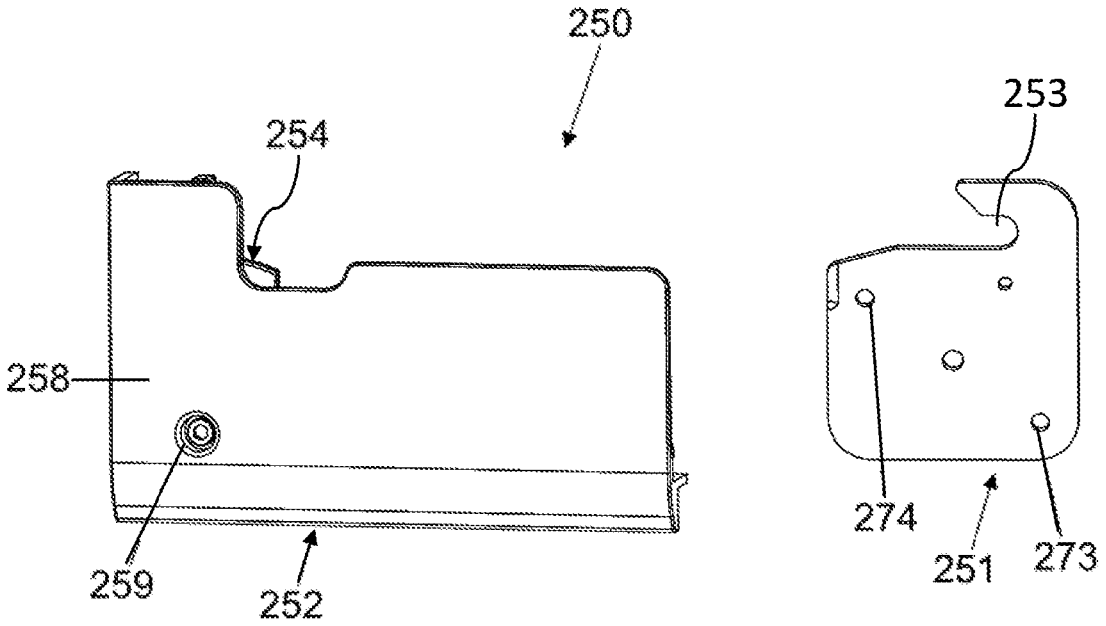
Figure 12A:
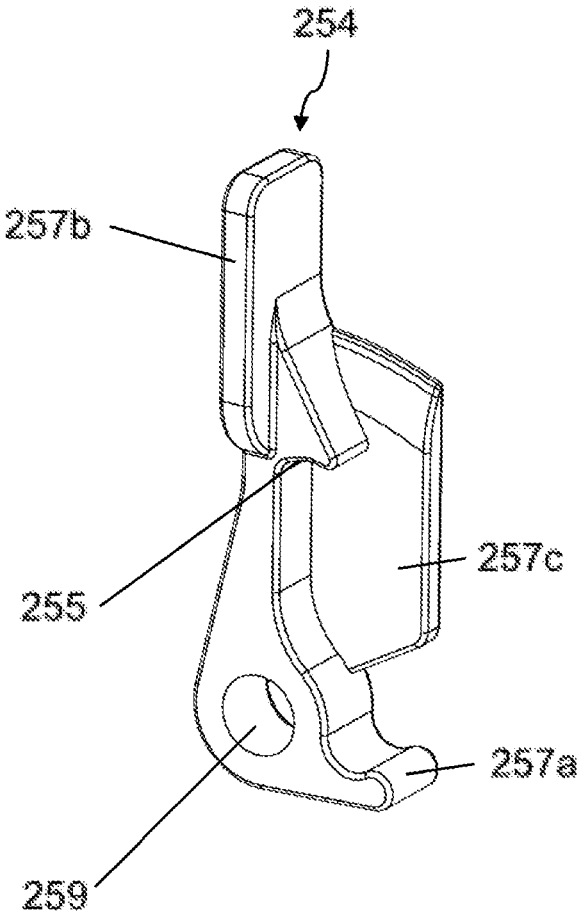
Figure 12B:
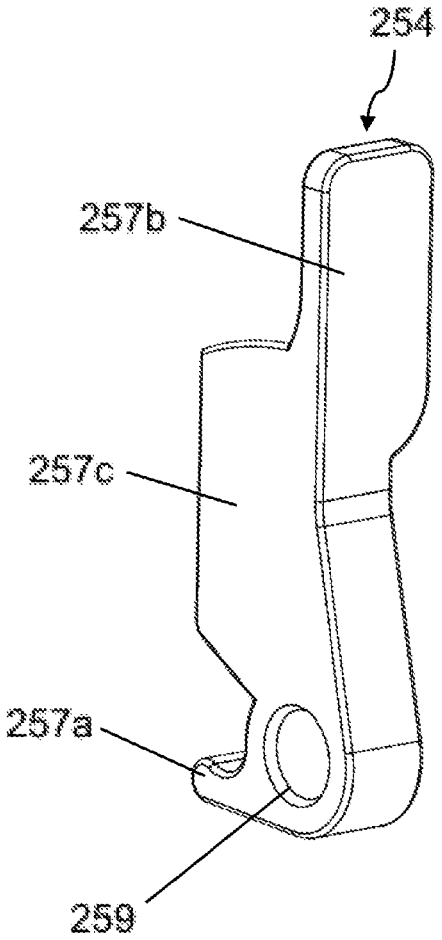
Figure 13A:
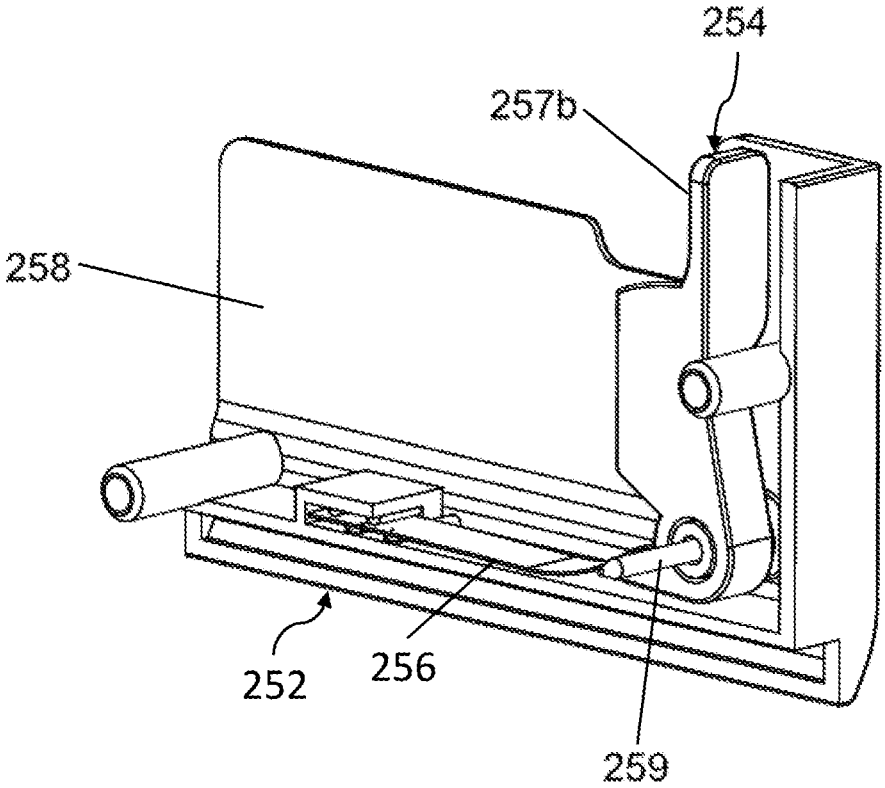
Figure 13B:
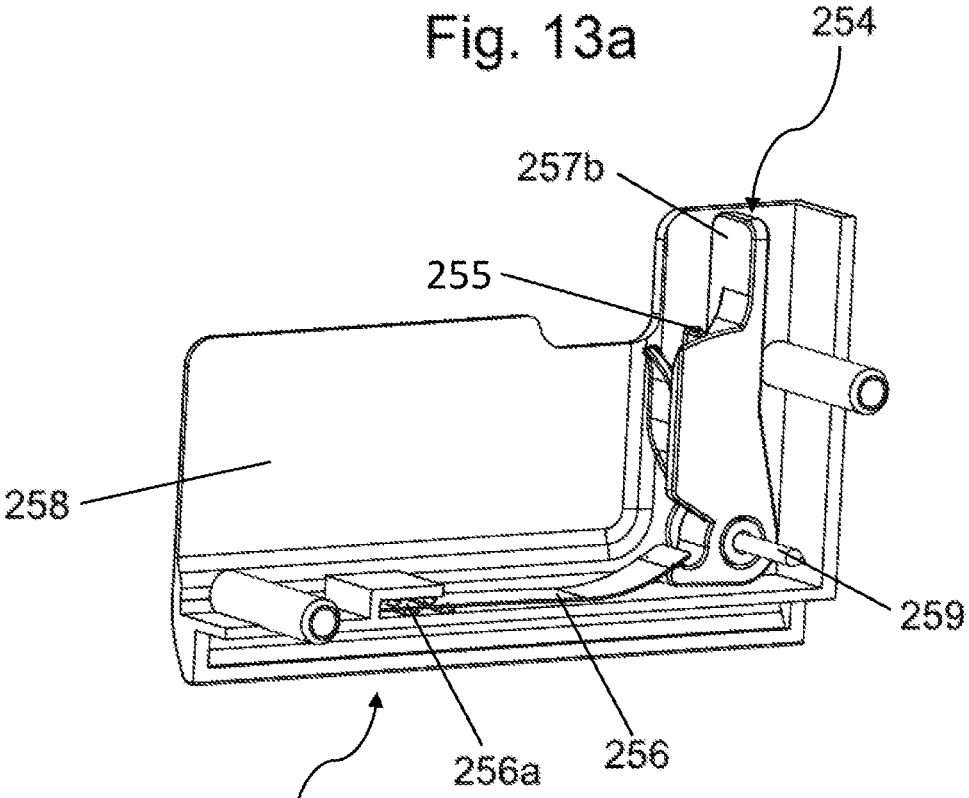
Figure 14A:
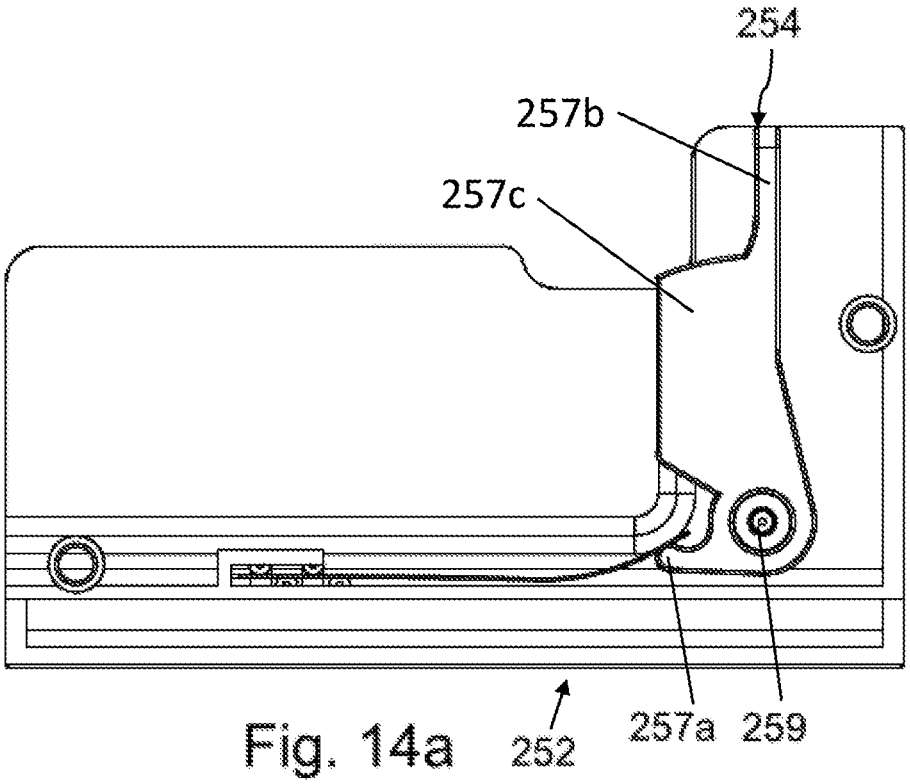
Figure 14B:
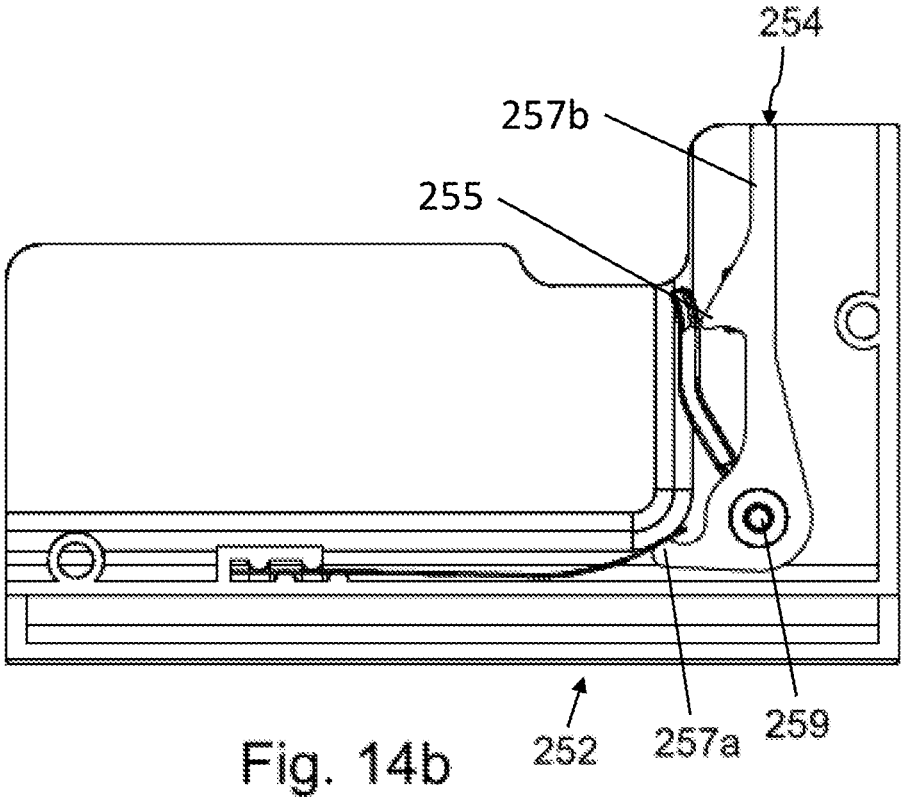

As a further detail, reference is initially made to FIGS. 4 and 8, in which the connection of the frame side covering element 1*b* and sash side covering element 2*b* to the respective hinge 110, 210 is carried out by a snap connection 160, 170; 260, 270. The snap connection typically comprises a snap anchor fastened to the covering element 1*b*, 2*b* and a holding clip formed in the relevant hinge part. An advantageous version of the snap anchor will be described in more detail below with reference to FIGS. 15 to 20.

In the first embodiment, it is noted that the snap connection 170 for connecting the covering element 1*b* to the hinge 110 is located on the mounting plate 151. In the second embodiment, the snap connection 270 for connecting the covering element 1*b* to the hinge 210 is located on the base plate 235 of the base plate 230.

In the following, it will be described in more detail how a snap connection 470 is carried out by introducing a snap anchor 80 connected to the covering element 1*b* into a holding clip 90 connected to a hinge generally designated 410.

The snap anchor 80 is generally pre-mounted onto the covering element 2*b*, 1*b* and the covering element may subsequently, after installing the hinge 410, be snapped in place. Referring back to FIG. 1, in which it also emerges how the frame side covering element 1*b* and sash side covering element 2*b* interact with each other, it is noted that the movement pattern of the hinge allows that the sash side covering element 2*b* is able to be retracted from its position under the frame side covering element 1*b* during the opening movement of the sash 2 relative to the frame 1, and conversely, be inserted under the frame side covering element 1*b* at the final stage of the closing movement.

Referring now to FIGS. 17 to 22, detailed views of the snap connection 470 are illustrated. Only the snap connection 470 of the frame hinge part of the hinge 410 will be described. Generally, the snap connection of the sash hinge part may be identical. In that way, the same snap anchor 80 can be used on either of the holding clips 90. The snap anchor 80 is thus connected to the covering arrangement 1*b*, 2*b* and configured for releasable connection directly to a respective holding clip 90 integral with the hinge 10 and arranged to receive the respective snap anchor 80.

Each holding clip 90 comprises a receiving portion 91 and an anchor engagement portion 92. The receiving portion 91 of the holding clip 90 is here substantially U-shaped and comprises two opposing supporting surfaces 93 extending between a respective upper end surface 95 and the anchor engagement portion 92. Introduction of the snap anchor 80 into the holding clip 90 is facilitated if at least one of the opposing surfaces 93 is provided with a rounded edge 94 at the transition between the respective upper end surface 95 and the supporting surface 93. The holding clip 90 furthermore has a front side 90*a* and a back side 90*b*.

The anchor engagement portion 92 of each holding clip 90 is in the embodiment shown formed as an offset section comprising at least one side surface 96 and a lower end surface 97. Here, there are two symmetrically arranged side surfaces 96 to end in the lower end surface 97, and the offset section has a front surface 98*a*, a back surface 98*b* and also an inclined upper surface 99.

Turning now to a description of preferred embodiments of the snap anchor with further reference to FIGS. 15 to 20, the snap anchor 80 comprises a top surface 85 configured to abut a lower side of the respective covering element 1*b*, 2*b*, a guide portion 81 and an engagement portion 82.

The guide portion 81 of the snap anchor 80 comprises two opposing guide surfaces 83 to interact with the two opposing supporting surfaces 93 of the receiving portion 91 of the holding clip 90. In order to facilitate the mounting process, each guide portion 81 may as shown be provided with a rounded lower edge 81*a*. Furthermore, and in particular for improving the retention of the snap anchor 80 in the holding clip 90, a protruding side wall portion 81*b* is also provided at both sides of the guide portion 81.

The engagement portion 82 comprises a tongue 88 and two legs 87 extending from the top surface 85 of the snap anchor 80 and meeting in a lower point 87*a* such that a slot 89 is formed between the legs 87 and the tongue 88. The tongue 88 is in the embodiment shown formed integral with the guide portion 81 of the snap anchor 80 and has a central aperture 88*a*. The central aperture 88*a* is present in order to facilitate the manufacturing process.

The engagement between the engagement portion 82 of the snap anchor 80 and the anchor engagement portion 92 of the holding clip 90 is performed in that the slot 89 of the engagement portion 82 of the snap anchor 80 surrounds the anchor engagement portion 92 of the holding clip 90 in the mounted condition.

In the mounted condition, a back surface 88*b* of the tongue 88 abuts the front surface 98*a* of the offset section of the anchor engagement portion 92 of the holding clip.

The legs 87 of the snap anchor 80 are pre-formed with a bias in a direction away from the tongue 88.

Furthermore, the snap anchor 80 comprises at least one resilient arm 86, here two resilient arms 86, connected at a transition portion 86*a* to the top surface 85 of the snap anchor 80 and having a free end portion 86*b*. As shown, the resilient arms 86 are in the embodiment shown located at a lower level than the top surface 85.

When mounting the covering elements 1*b*, 2*b* to which the snap anchors 80 have been connected, the snap anchor 80 is introduced into the holding clip 90 as indicated in the above and moved downwards in the receiving portion 91. In order to attain the releasable connection, the engagement portion 82 is moved further downwards until the lower part of the slot 89 is located below the lower end surface 97 of the offset section of the anchor engagement portion 92.

In the snap connection, a slight play is necessary in order to allow the slot 89 of the engagement portion 82 of the snap anchor 80 to be guided over the anchor engagement portion 92. Furthermore, unavoidable tolerances in the parts of the hinge including the holding clip 90, and in the snap anchor 80 itself, make it advantageous to incorporate resilient means into the connection. Such resilient means may take any suitable form, but here the required play and any tolerances are accommodated by the presence of the resilient arms 86 at the top surface 85 of the snap anchor 80. Once the engagement portion 82 has been brought into engagement with the anchor engagement portion 92, the free end portions 86*a* of the resilient arms 86 come into contact with the respective upper end surface 95 of the holding clip 90. When the resilient legs 86 bend, the relative movement will in turn pull the legs 87 upwards and thereby ensure abutment between the lower point 87*a* with the lower end surface 97 of the anchor engagement portion 92 of the holding clip 90.

In the mounted condition, and in the case of a pulling force acting on the associated covering element, either as a mechanical force when handling the window or due to wind load, the configuration of the snap anchor 80 will support the snap engagement and prevent unwarranted release from the holding clip 90 of the hinge 10.

As a first measure to retain the snap engagement, this is obtained by the fact that a tensional load transmitted via the symmetrically arranged legs 87 gives rise to substantially radial reaction forces having as their centre a position in the offset section of the anchor engagement portion 92 defined by radius of curvature of the side surfaces 96 and the lower end surface 97 of the anchor engagement portion, thereby reducing stress caused by moment to an absolute minimum, leaving only tension stress in legs 87 and lower point 87*a*.

A further factor contributing to enforcing the snap engagement in the mounted condition is the configuration of the legs 87 with a pre-formed bias to force the legs 87 as close to the centre of the snap anchor 80 as possible. In this manner, the respective line of action of a pulling force acting substantially centrally in the snap anchor 80 on one hand and the reaction force between the legs 87 and lower point 87*a* with the anchor engagement portion 92 on the other will be located close to each other and hence the resulting moment will be minimized. Optimally, the lines of actions coincide.

Finally, stability of the snap anchor 80 in the holding clip 90 and in turn of the associated covering element 1*b* is provided by the arrangement of suitable abutment surfaces between back sides of the legs 87 and front sides 90*a* of the holding clip 90 and between the protruding side wall portions 81*b* of the guide portion 81 and the back sides 90*b* of the holding clip 90. In an optimal configuration, these abutment surfaces are all plane and parallel to each other; however, this may be difficult to obtain in practice due to for instance practical considerations during moulding of the snap anchor 80. A sufficient stability is obtained if only opposing abutment surfaces are present though.

In case it is for some reason desirable to dismount the covering element from the hinge, release of the snap engagement is particularly easy as the snap anchor 80 as in the shown embodiment comprises a grip portion 84 formed at the ends of the legs 87 opposite the top surface 85.

The connection between the snap anchor and the covering element 1*b*, 2*b* may in principle be carried out in any suitable manner, including introducing a fastening element such as a screw or rivet into an opening in the top surface of the snap anchor. Such a rivet would be for instance a blind or pop rivet on the covering element 1*b*, 2*b*, further provided with an external thread to engage the opening in the snap anchor. Alternatively, or additionally, the snap anchor could be connected to the covering element 1*b*, 2*b* by an adhesive connection, this renders the presence of fastening means such as a screw or rivet redundant, and the snap anchor is so to say integral with the covering element. As a further alternative, the snap anchor may be connected to the covering element as described in Applicant's published WO 2018/077367 A1.

It is to be understood that the locking and the mounting may differ depending on the specific installation and the specific hinge. The hinge with mounting arrangement described may also be suitable for any window, including roof windows at any inclination and facade windows of any size. Also some different shapes when possible to use a hinge as the one described.

It should be noted that the above description of preferred embodiments serves only as an example, and that a person skilled in the art will know that numerous variations are possible without deviating from the scope of the claims.

LIST OF REFERENCE NUMERALS

1 frame
1*a* frame side member
1*b* frame covering element
2 sash
2*a* sash side member
2*b* sash covering element
3 pane
10' hinge (prior art)
110 hinge (first embodiment)
130 frame hinge part
135 base plate
140 sash hinge part
145 base plate
150 mounting arrangement
151 mounting plate
151*a* outer surface
151*b* inner surface set of coupling means of mounting arrangement
153 first reception member/slot
154 second reception member/latch element
155 abutment portion
156 leaf spring
157*a* spring engagement portion
157*b* tongue portion1
157*c* guide portion
159 pivotal connection coupling means of remaining components of set of hinge components
163 first engagement member/bolt
164 second engagement member/shoulder portion
165 protruding bottom portion
173 hole in mounting plate for spigot
174 hole in mounting plate for spigot
160 snap connection (sash hinge part)
170 snap connection (frame hinge part)
190 movement supporting parts
210 hinge (second embodiment)
230 frame hinge part
235 base plate
240 sash hinge part
245 base plate
250 mounting arrangement
251 first mounting plate
252 second mounting plate set of coupling means of mounting arrangement
253 first reception member/slot
254 second reception member/latch element
255 abutment portion
257*a* spring engagement portion
257*b* tongue portion
257*c* guide portion
258 cover portion
259 pivotal connection coupling means of remaining components of set of hinge components
263 first engagement member/bolt
264 second engagement member/shoulder portion
265 protruding bottom portion

271*a* spigot on first mounting plate
271*b* spigot on first mounting plate
272*a* spigot on second mounting plate
272*b* spigot on second mounting plate
273 hole in mounting plate for spigot 271*a*
274 hole in mounting plate for spigot 271*b*
260 snap connection (sash hinge part)
270 snap connection (frame hinge part)
290 movement supporting parts
310 hinge (third embodiment)
350 mounting arrangement
351 mounting plate
351*a* spring engagement protrusion
351*b* first cover engagement protrusion
351*c* second cover engagement protrusion
353 first reception member/slot
354 second reception member/latch element
358 cover
358*a* first spring abutment portion
358*b* first engagement means
358*c* second engagement means
358*d* second spring abutment portion
359 pivotal connection
α hinge axis
410 hinge (fourth embodiment)
470 snap connection
80 snap anchor
81 guide portion
81*a* rounded lower edge of guide portion
81*b* protruding side wall portion of guide portion
82 engagement portion
83 guide surface
84 grip portion
85 top surface
85*a* opening
86 resilient arm
86*a* transition portion of resilient arm
86*b* free end portion of resilient arm
87 leg
87*a* lower point
88 tongue
88*a* aperture in tongue
88*b* back surface of tongue
89 slot
90 holding clip
90*a* front side of holding clip
91 receiving portion
92 anchor engagement portion
93 supporting surface
94 rounded edge
95 upper end surface
96 side surface of anchor engagement portion
97 lower end surface of anchor engagement portion
98*a* front surface of offset section
98*b* back surface of offset section
99 inclined upper surface

The invention claimed is:

1. A hinge (110; 210; 310) for a window having a frame (1) and a sash (2) and adapted to define a hinge axis (α) of the window, said hinge comprising a set of hinge components including:

a frame hinge part (130; 230) having a base plate (135; 235) configured to be connected to a frame member (1*a*) of the frame;

a sash hinge part (140; 240) having a base plate (145; 245) configured to be connected to a sash member (2*a*) of the sash;

a mounting arrangement (150; 250; 350) configured to assist in bringing the hinge (110; 210) from a supply condition to a mounted condition, in which the base plate (135; 235) of the frame hinge part (130; 230) is connected to the frame member (1*a*) and the base plate (145; 245) of the sash hinge part (140; 240) is connected to the sash member (2*a*); and a plurality of movement supporting parts (190; 290), connected to a respective base plate (135, 145; 235; 245) of the frame hinge part (130; 230) and the sash hinge part (140; 240), and configured to allow the sash hinge part (140; 240) to assume an angle relative to the frame hinge part (130; 230), in which the base plate (135; 235) of the frame hinge part (130; 230) defines a hinge plane substantially perpendicular to the hinge axis (α) of the window in the mounted condition of the hinge, the base plate (145; 245) of the sash hinge part (140; 240) being substantially parallel to the base plate (135; 235) of the frame hinge part (130; 230), in which the mounting arrangement (150; 250; 350) comprises at least one mounting plate (151; 251, 252; 351), adapted to be arranged on the frame member (1*a*) substantially in parallel to the base plate (135; 235) of the frame hinge part (130; 230) in the mounted condition, and at least one set of coupling means (153, 154; 253, 254; 353; 354) configured to engage with corresponding coupling means (163, 164; 263, 264) of the remaining components of the set of components of the hinge (110; 210; 310), wherein the coupling means of the mounting arrangement (150; 250) comprise at least one reception member (153, 154; 253, 254; 353; 354) provided on the at least one mounting plate (151; 251, 252; 351) to engage with a respective engagement member (163, 164; 263, 264) of the coupling means of the remaining components of the hinge by movement of the remaining components of the hinge substantially in parallel with said hinge plane to provide a releasable connection between the remaining components of the hinge (110; 210) and the at least one mounting plate (151; 251, 252; 351), an in which a first engagement member of the coupling means of the remaining components of the hinge is a bolt (163; 263) provided on the base plate (135; 235) of the frame hinge part (130; 230), and the at least one reception member of the coupling means of the mounting arrangement includes a first reception member which is a slot (153; 253; 353) in said at least one mounting plate (151; 251; 351) adapted to receive said bolt (163; 263), to provide an at least temporary retention of the remaining components of the hinge relative to the at least one mounting plate (151; 251; 351), characterized in that a second engagement member of the coupling means of the remaining components comprises a shoulder portion (164; 264), and a second reception member of the coupling means of the mounting arrangement (150; 250; 350) comprises a spring-biased latch element (154; 254; 354) provided with an abutment portion (155; 255) to engage with said shoulder portion (164; 264) in the mounted condition, that the spring bias of the spring-biased latch element (154; 254; 354) is provided by a leaf spring (156; 256; 356) and the spring-biased latch element (154; 254) includes a spring engagement portion (157*a*; 257*a*), and that the spring-biased latch element includes a tongue portion (157*b*; 257*b*) acting as a handle for release of the releasable connection.

2. The hinge (110; 210; 310) according to claim 1, wherein the spring-biased latch element (154; 254; 354) is connected to said at least one mounting plate (151; 252; 351) in a pivotal connection (159; 259; 359).

3. The hinge (110; 210; 310) according to claim 2, wherein the at least one mounting plate (252; 351) includes a spring pocket (256*a*) or a spring engagement protrusion (351*a*).

4. The hinge (110; 210; 310) according to claim 2, wherein the spring-biased latch element (154; 254; 354) includes a guide portion (157*c*; 257*c*).

5. The hinge (110; 210; 310) according to claim 1, wherein the at least one mounting plate (252; 351) includes a spring pocket (256*a*) or a spring engagement protrusion (351*a*).

6. The hinge (110; 210; 310) according to claim 5, wherein the base plate (135; 235) of the frame hinge part (130; 230) is provided with a protruding bottom portion (165; 265) to interact with the leaf spring (156; 256).

7. The hinge (110; 210; 310) according to claim 1, wherein the spring-biased latch element (154; 254; 354) includes a guide portion (157*c*; 257*c*).

8. The hinge (210) according to claim 1, wherein the mounting arrangement (250) comprises a first mounting plate (251) and a second mounting plate (252).

9. The hinge (210) according to claim 8, wherein the second mounting plate (252) comprises a cover portion (258).

10. The hinge (310) according to claim 1, wherein the mounting arrangement (350) comprises a cover (358) with first and second engagement means (358*b*, 358*c*) and the mounting plate (351) is provided with first and second cover engagement protrusions (351*b*, 351*c*).

11. The hinge (110; 210; 310) according to claim 1, wherein the plurality of movement supporting parts (190; 290) of the hinge comprises a linkage mechanism including links, springs and at least one pick-up element to provide the hinge as a pantograph hinge.

12. A window including a set of hinges (110; 210; 310), the window, comprising a frame (1) having a top member, a bottom member and two side members (1*a*) defining a frame plane, a sash (2) having a top member, a bottom member and two side members (2*a*), said sash carrying a pane (3) and defining a sash plane, said set of hinges (110; 210) defining a hinge axis (α) of the window;

at least one hinge of said set of hinges comprising a set of hinge components including:

a frame hinge part (130; 230) having a base plate (135; 235) configured to be connected to a frame member (1*a*) of the frame;

a sash hinge part (140; 240) having a base plate (145; 245) configured to be connected to a sash member (2*a*) of the sash;

a mounting arrangement (150; 250; 350) configured to assist in bringing the hinge (110; 210) from a supply condition to a mounted condition, in which the base plate (135; 235) of the frame hinge part (130; 230) is connected to the frame member (1*a*) and the base plate (145; 245) of the sash hinge part (140; 240) to the sash member (2*a*); and a plurality of movement supporting parts (190; 290), connected to a respective base plate (135, 145; 235; 245) of the frame hinge part (130; 230) and the sash hinge part (140; 240), and configured to allow the sash hinge part (140; 240) to assume an angle relative to the frame hinge part (130; 230), in which the base plate (135; 235) of the frame hinge part (130; 230) defines a hinge plane substantially perpendicular to the hinge axis (α) of the window in the mounted condition of the hinge, the base plate (145; 245) of the sash hinge part (140; 240) being substantially parallel to the base plate (135; 235) of the frame hinge part (130; 230), in which the mounting arrangement (150; 250; 350) comprises at least one mounting plate (151; 251, 252; 351), adapted to be arranged on the frame member (1*a*) substantially in parallel to the base plate (135; 235) of the frame hinge part (130; 230) in the mounted condition, and at least one set of coupling means (153, 154; 253, 254; 353; 354) configured to engage with corresponding coupling means (163, 164; 263, 264) of the remaining components of the set of components of the hinge (110; 210; 310), wherein the coupling means of the mounting arrangement (150; 250) comprise at least one reception member (153, 154; 253, 254; 353; 354) provided on the at least one mounting plate (151; 251, 252; 351) to engage with a respective engagement member (163, 164; 263, 264) of the coupling means of the remaining components of the hinge by movement of the remaining components of the hinge substantially in parallel with said hinge plane to provide a releasable connection between the remaining components of the hinge (110; 210) and the at least one mounting plate (151; 251, 252; 351), an in which a first engagement member of the coupling means of the remaining components of the hinge is a bolt (163; 263) provided on the base plate (135; 235) of the frame hinge part (130; 230), and the at least one reception member of the coupling means of the mounting arrangement includes a first reception member which is a slot (153; 253; 353) in said at least one mounting plate (151; 251; 351) adapted to receive said bolt (163; 263), to provide an at least temporary retention of the remaining components of the hinge relative to the at least one mounting plate (151; 251; 351), and a second engagement member of the coupling means of the remaining components comprises a shoulder portion (164; 264), and a second reception member of the coupling means of the mounting arrangement (150; 250; 350) comprises a spring-biased latch element (154; 254; 354) provided with an abutment portion (155; 255) to engage with said shoulder portion (164; 264) in the mounted condition, that the spring bias of the latch element (154; 254; 354) is provided by a leaf spring (156; 256; 356) and the latch element (154; 254) includes a spring engagement portion 9157*a*; 257*a*), and that the spring-biased latch element includes a tongue portion (157*b*; 257*b*) acting as a handle for release of the releasable connection.

13. The window according to claim 12, wherein the spring-biased latch element (154; 254; 354) is connected to said at least one mounting plate (151; 252; 351) in a pivotal connection (159; 259; 359).

14. The window according to claim 12, wherein the at least one mounting plate (252; 351) includes a spring pocket (256*a*) or a spring engagement protrusion (351*a*).

15. The window according to claim 14, wherein the base plate (135; 235) of the frame hinge part (130; 230) is provided with a protruding bottom portion (165; 265) to interact with the leaf spring (156; 256).

16. The window according to claim 12, wherein the spring-biased latch element (154; 254; 354) includes a guide portion (157*c*; 257*c*).

17. The window according to claim 12, wherein the mounting arrangement (250) comprises a first mounting plate (251) and a second mounting plate (252).

18. A method of installing a window, comprising the steps of:

providing a hinge comprising a set of hinge components including:

a frame hinge part (130; 230) having a base plate (135; 235) configured to be connected to a frame member (1*a*) of the frame.

a sash hinge part (140; 240) having a base plate (145; 245) configured to be connected to a sash member (2*a*) of the sash;

a mounting arrangement (150; 250; 350) configured to assist in bringing the hinge (110; 210) from a supply condition to a mounted condition, in which the base plate (135; 235) of the frame hinge part (130; 230) is connected to the frame member (1*a*) and the base plate (145; 245) of the sash hinge part (140; 240) to the sash member (2*a*); and a plurality of movement supporting parts (190; 290), connected to a respective base plate (135, 145; 235; 245) of the frame hinge part (130; 230) and the sash hinge part (140; 240), and configured to allow the sash hinge part (140; 240) to assume an angle relative to the frame hinge part (130; 230), in which the base plate (135; 235) of the frame hinge part (130; 230) defines a hinge plane substantially perpendicular to the hinge axis ($\alpha$) of the window in the mounted condition of the hinge, the base plate (145; 245) of the sash hinge part (140; 240) being substantially parallel to the base plate (135; 235) of the frame hinge part (130; 230), in which the mounting arrangement (150; 250; 350) comprises at least one mounting plate (151; 251, 252; 351), adapted to be arranged on the frame member (1*a*) substantially in parallel to the base plate (135; 235) of the frame hinge part (130; 230) in the mounted condition, and at least one set of coupling means (153, 154; 253, 254; 353; 354) configured to engage with corresponding coupling means (163, 164; 263, 264) of the remaining components of the set of components of the hinge (110; 210; 310), wherein the coupling means of the mounting arrangement (150; 250) comprise at least one reception member (153, 154; 253, 254; 353; 354) provided on the at least one mounting plate (151; 251, 252; 351) to engage with a respective engagement member (163, 164; 263, 264) of the coupling means of the remaining components of the hinge by movement of the remaining components of the hinge substantially in parallel with said hinge plane to provide a releasable connection between the remaining components of the hinge (110; 210) and the at least one mounting plate (151; 251, 252; 351), an in which a first engagement member of the coupling means of the remaining components of the hinge is a bolt (163; 263) provided on the base plate (135; 235) of the frame hinge part (130; 230), and the at least one reception member of the coupling means of the mounting arrangement includes a first reception member which is a slot (153; 253; 353) in said at least one mounting plate (151; 251; 351) adapted to receive said bolt (163; 263), to provide an at least temporary retention of the remaining components of the hinge relative to the at least one mounting plate (151; 251; 351), and a second engagement member of the coupling means of the remaining components comprises a shoulder portion (164; 264), and a second reception member of the coupling means of the mounting arrangement (150; 250; 350) comprises a spring-biased latch element (154; 254; 354) provided with an abutment portion (155; 255) to engage with said shoulder portion (164; 264) in the mounted condition, that the spring bias of the latch element (154; 254; 354) is provided by a leaf spring (156; 256; 356) and the latch element (154; 254) includes a spring engagement portion 9157*a*; 257*a*), and that the spring-biased latch element includes a tongue portion (157*b*; 257*b*) acting as a handle for release of the releasable connection connecting the at least one mounting plate (151; 251, 252; 351) to the frame (1), connecting the remaining components of the set of components of the hinge to the sash (2), and engaging the coupling means of the remaining components with the coupling means of the mounting arrangement by moving the remaining components of the hinge substantially in parallel with said hinge plane, by, in a first step, engaging the bolt (163; 263) provided on the base plate (135; 235) of the frame hinge part (130; 230) with the slot (153; 253; 353) in said at least one mounting plate (151; 251; 351), and, in a second step allowing the spring-biased latch element (154; 254; 354) to engage with said shoulder portion (164; 264) to obtain secure engagement in the mounted condition.

19. The method of claim 18, whereby the first step of engaging the coupling means of the remaining components with the coupling means of the mounting arrangement is carried out by first sliding the bolt (163; 263) into the slot (153; 253; 353) and subsequently rotating the base plate (135; 235) of the frame hinge part (130; 230) and the other remaining components of the hinge (110; 210) about the bolt (163; 263).

* * * * *